US006934490B2

(12) United States Patent
Koyama et al.

(10) Patent No.: US 6,934,490 B2
(45) Date of Patent: Aug. 23, 2005

(54) TONER CONTAINER, PRINT PROCESS CARTRIDGE AND IMAGE FORMING APPARATUS

(75) Inventors: Tetsu Koyama, Tokyo (JP); Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/649,268

(22) Filed: Aug. 27, 2003

(65) Prior Publication Data

US 2004/0047651 A1 Mar. 11, 2004

(30) Foreign Application Priority Data

Aug. 27, 2002 (JP) ..... 2002-246849

(51) Int. Cl.[7] ..... G03G 15/08
(52) U.S. Cl. ..... 399/120
(58) Field of Search ..... 399/120, 358, 399/359, 360

(56) References Cited

U.S. PATENT DOCUMENTS 5,128,724 A * 7/1992 Hayashi et al. ..... 399/359
5,132,740 A * 7/1992 Okamoto et al. ..... 399/360
5,260,750 A * 11/1993 Ishida et al. ..... 399/359
5,592,270 A * 1/1997 Takai et al.
6,363,233 B1 * 3/2002 Nakajima ..... 399/120
6,418,284 B1 * 7/2002 Mercer ..... 399/120
6,496,671 B2 * 12/2002 Nakajima ..... 399/120
2001/0001025 A1 5/2001 Nakajima

FOREIGN PATENT DOCUMENTS

JP 11-153901 8/1999

* cited by examiner

*Primary Examiner*—Susan Lee
(74) *Attorney, Agent, or Firm*—Akin Gump Strauss Hauer & Feld, LLP

(57) ABSTRACT

A toner container 40 includes a fresh toner chamber 46 and a waste toner chamber 47 separated by a partition wall 45. A width "a" of the interior of the fresh toner chamber 46 at an arbitrary vertical position VP along the partition wall 45 is substantially equal to or less than a corresponding width "b" at another position below the vertical position VP. The waste toner chamber 47 has a waste toner collection opening 55 through which a toner discharging mechanism 32 is inserted. A guide member 56 guides a discharging lid 57 for opening and closing the waste toner collection opening 55. The guide member 56 extends inwardly from the vicinity of an upper periphery of the waste toner collection opening 55, so that the toner discharging mechanism 32 that has entered in the waste toner chamber 47 is covered by the guide member 56 from above.

12 Claims, 14 Drawing Sheets

TONER CONTAINER, PRINT PROCESS CARTRIDGE AND IMAGE FORMING APPARATUS

BACKGROUND OF THE INVENTION

This invention relates to an image forming apparatus such as an electrophotographic recording apparatus, and relates to a print process cartridge and a toner container used in the image forming apparatus.

In an electrophotographic recording apparatus, a uniformly charged surface of a photosensitive body is exposed to the light to form a latent image. Toner adheres to the latent image by electrostatic force to form a visible toner image, and the visible toner image is transferred to a printing paper. The printing paper is fed through a fixing device by which the toner image is fixed to the printing paper.

In a process in which the toner image is transferred to the printing paper, the residual toner that remains on the photosensitive body is removed by a cleaning device, and collected by a waste toner collecting device. Generally, the waste toner collecting device is detachably mounted in the electrophotographic recording apparatus.

FIG. 19 is an exploded perspective view of the main part of a conventional toner container that constitutes the above described waste toner collecting device. The toner container is able to accommodate waste toner and fresh toner as described later.

As shown in FIG. 19, the toner container 101 includes a fresh toner chamber 102, a waste toner chamber 103, and a partition wall 113 separating the fresh toner chamber 102 from the waste toner chamber 103. A fresh toner supply opening 104 is formed on the bottom of the fresh toner chamber 102, through which the fresh toner is supplied to a not-shown developing device. An opening-and-closing device 106 is rotatably provided in the lower part of the fresh toner chamber 102 and is disposed on the fresh toner supply opening 104. The opening-and-closing device 106 has an opening 108 and an operation lever 107. By operating the operation lever 107 to rotate the opening-and-closing device 106, the opening 108 can be aligned with the fresh toner supply opening 104 so that the fresh toner is supplied to the developing device.

A side plate 120 is provided on the side of the toner container 101. The side plate 120 has fixing projections 114, and is fixed to the toner container 101 so that fixing projections 114 engage fixing holes 105 formed on the toner container 101. The side plate 120 has a waste toner collection opening 109 that opens to the interior of the waste toner chamber 103. A guide frame 110 is formed on the inner side (i.e., the waste toner chamber 103 side) of the side plate 120 in such a manner that the guide frame 110 vertically bridges the waste toner collection opening 109.

A lid 111 is guided by the guide frame 110 so that the lid 111 is slidable within a predetermined range in the longitudinal direction of the toner container 101. The lid 111 is urged by a spring 112 toward the waste toner collection opening 109 so that the lid 111 closes the waste toner collection opening 109 from inside of the waste toner chamber 103.

A screw conveyer (described later) is provided in the electrophotographic recording apparatus for conveying the waste toner removed by the cleaning device from the photosensitive body. When the toner container 101 constructed as above is mounted in the electrophotographic recording apparatus, a toner discharging portion of the screw conveyor urges the lid 111 to open the waste toner collection opening 109, and enters into the waste toner chamber 103 through the waste toner collection opening 109.

In this state, the waste toner is discharged from the screw conveyor so that the waste toner falls from the toner discharging portion. The discharged waste toner is accommodated in the waste toner chamber 103. When the waste toner chamber 103 is filled with the waste toner, or when the fresh toner chamber 102 becomes empty, the toner container 101 is detached from electrophotographic recording apparatus.

When the toner container 101 is detached from the electrophotographic recording apparatus, the toner discharging portion of the screw conveyor is pulled out of the waste toner chamber 103 through the waste toner collection opening 109. In accordance with the movement of the toner discharging portion relative to the waste toner collection opening 109 (caused by the movement of the waste toner collection opening 109 of the toner container 101), the lid 111 moves toward the waste toner collection opening 109 and closes the waste toner collection opening 109 from inside the waste toner chamber 103. Because the waste toner collection opening 109 is closed by the lid 111, the leakage of the waste toner out of the toner container 101 is prevented, when the toner container 101 is detached from the electrophotographic recording apparatus, or when the toner container 101 is transported.

In the above described conventional toner container 101 for the electrophotographic recording apparatus, the waste toner chamber 103 is disposed in a lower part of the toner container 101 as shown in FIG. 19, and therefore the fresh toner chamber 102 has a narrow part. Such a narrow part may be clogged with the fresh toner, and causes a problem that the fresh toner in the upper part of the fresh toner chamber 102 may not be supplied to the developing device.

Moreover, in a state where the toner discharging portion of the screw conveyor has entered into the waste toner chamber 103, no cover is provided above the toner discharging portion of the screw conveyor. The guide frame 110 does not sufficiently cover the toner discharging portion from above. Thus, the waste toner above the guide frame 110 may fall on the toner discharging portion of the screw conveyor or on the path of the lid 111. Accordingly, when the toner container 101 is detached from the electrophotographic recording apparatus, the waste toner may leak out of the toner container 101 in accordance with the movement of the toner discharging portion of the screw conveyor. Particularly, the amount of the toner that falls on the toner discharging portion or the like is larger when the toner container 101 is inclined during the detachment process of the toner container 101 than when the toner container 101 is kept horizontal during the detachment process. This is because the toner in a stationary state may lose its balance when the toner container 101 is inclined.

Further, there is a possibility that the waste toner may leak out of the screw container through the toner discharging portion, when the toner container 101 is attached to or detached from a print process cartridge of the electrophotographic apparatus.

Additionally, there is a type of toner container having another screw conveyor in the waste toner chamber 103. In such a toner container, a load is imposed on a rotation shaft of the screw conveyor by the waste toner. As the amount of the waste toner accommodated in the waste toner chamber increases, the load imposed on the screw conveyor increases, with the result that the screw conveyor may not rotate correctly and may have a difficulty in conveying the waste toner.

SUMMARY OF THE INVENTION

In order to solve the above described problems, objects of the present invention are:

(1) to provide a developer container capable of efficiently supplying fresh developer through a fresh developer supply opening without leaving the fresh developer unused in the developer container;

(2) to provide a print process cartridge and a developer container capable of preventing the leakage of the waste developer when the developer container is attached to or detached from the print process cartridge;

(3) to provided a developer container capable of preventing a developer conveyor from having a difficulty in conveying the waste developer even when the amount of the waste developer accommodated in the waste developer chamber increases; and (4) to provide an image forming apparatus including the above described developer container or print process cartridge, and capable of maintaining an excellent operating condition.

According to the invention, there is provided a developer container detachably mountable in an image forming apparatus. The developer container includes a hollow elongated outer body in which a fresh developer accommodating portion and a waste developer accommodating portion are provided. The fresh developer accommodating portion accommodates fresh developer, and the waste developer accommodating portion accommodates waste developer. The developer container further includes a partition wall that separates the fresh developer accommodating portion from the waste developer accommodating portion in such a manner that the accommodating portions extend in the longitudinal direction of the outer body so that the accommodating portions are adjacent to each other. A width, in the horizontal direction substantially perpendicular to the longitudinal direction, of the interior of the fresh developer accommodating portion at an arbitrary vertical position along the partition wall is substantially equal to or less than a corresponding width at another position below the arbitrary vertical position in a state where the developer container is mounted in the image forming apparatus.

With such an arrangement, the fresh developer accommodating portion has no narrow part, and therefore the fresh developer accommodated in the upper part of the fresh developer accommodating portion efficiently moves to the lower part of the fresh developer accommodating portion. Thus, it becomes possible to efficiently supply the fresh developer to a developing device of an image forming apparatus.

DETAILED DESCRIPTION OF THE INVENTION

Embodiments of the present invention will be described with reference to the attached drawings.

Embodiment 1.

Figure 1:
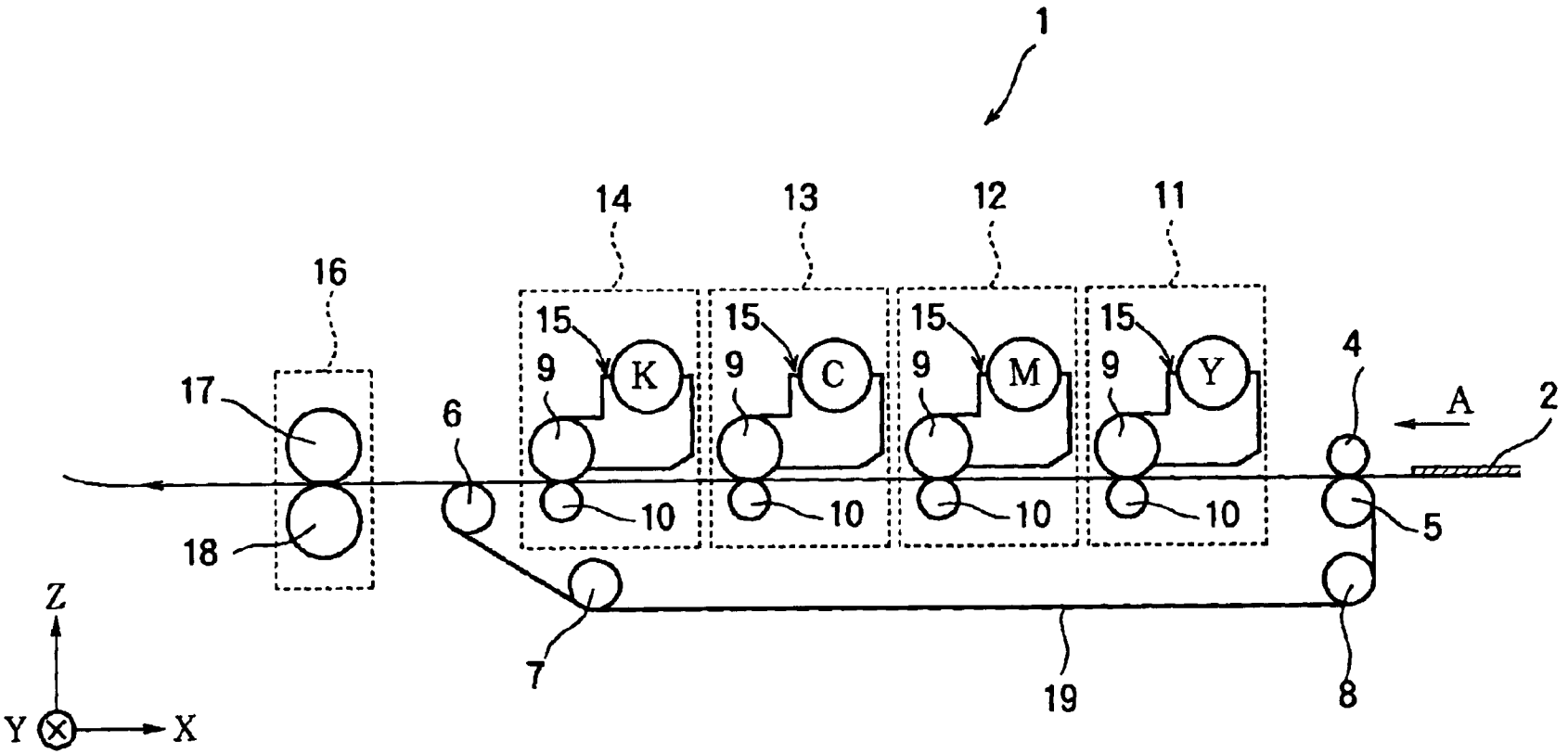
FIG. 1 is a schematic view of the main part of an image forming apparatus according to Embodiment 1 of the present invention.

FIG. 1 is a schematic view of the main part of an image forming apparatus 1 according to Embodiment 1 of the present invention.

The image forming apparatus 1 is a color printer of a so-called single-path type (i.e., a tandem type). The image forming apparatus 1 includes a Y-image forming portion 11, an M-image forming portion 12, a C-image forming portion 13 and a K-image forming portion 14 arranged in this order in a feeding direction A of a printing paper 2. The image forming portions 11, 12, 13 and 14 respectively transfer toner images of Y (yellow), M (magenta), C (cyan) and K (black) on the printing paper 2.

Each of the image forming portions 11 through 14 uniformly charges a latent image bearing member, exposes the latent image bearing member to the light using an LED (light emitting diode) to form a latent image, develops the latent image with toner and transfers the developed toner image to the printing paper 2. In each of the image forming portions 11 through 14, a photosensitive drum (i.e., the latent image bearing member) 9, a charging portion, a developing portion and a cleaning portion integrally constitute a print process cartridge 15. The print process cartridge 15 is detachable as one unit.

As shown in FIG. 1, X-axis is defined as an axis parallel to the feeding direction A of the printing paper 2, and Y-axis is defined as an axis perpendicular to X-axis and parallel to the surface of the printing paper 2 fed in the feeding direction A. Z-axis is defined as an axis perpendicular to X-axis and Y-axis. In other drawings described later, X-axis, Y-axis and Z-axis are defined as those in FIG. 1.

A feeding belt 19 is nipped by the photosensitive drums 9 of the image forming portions 11 through 14 and transfer rollers 10 respectively provided below the photosensitive drums 9. The feeding belt 19 is stretched around a driving roller 6, a tensioning roller 7, and driven rollers 5 and 8. The feeding belt 19 moves in the above described feeding direction A. The feed roller 4 is disposed above the driven roller 5 so that the feeding belt 19 is nipped by the feed roller 4 and the driven roller 5.

The printing paper 2 is supplied by a not shown paper supplying device, and fed by the feeding belt 19 through the nip portions between the photosensitive drums 9 and transfer rollers 10 of the image forming portions 11 through 14. The image forming portions 11 through 14 successively form toner images of the respective colors on the printing paper 2.

The feeding belt 19 is made of a semiconductive plastic film having high electric resistance. The electric resistance of the feeding belt 19 is so set that the printing paper 2 adheres to the feeding belt 19 by electrostatic force, and the electrostatic charge is naturally discharged from the feeding belt 19 when the printing paper 2 is separated from the feeding belt 19.

The printing paper 2 is separated from the feeding belt 19 when the printing paper 2 reaches the driving roller 6. A not shown static eliminator is disposed on the upper side of the driving roller 6 so that the static eliminator faces the driving roller 6. The static eliminator discharges the electrostatic charge of the printing paper 2 to release the printing paper 2 from the feeding belt 19 so that the printing paper 2 can easily be separated from the feeding belt 19.

A fixing device 16 is disposed on the downstream side of the driving roller 6 in the feeding direction A of the printing paper 2. The fixing device 16 includes a fixing roller 17 and a pressure roller 18. The fixing roller 17 has a heat source (not shown) and heats the surface of the printing paper 2 on which the toner image is formed. The pressure roller 18 is disposed below the fixing roller 17, and urges the printing paper 2 against the fixing roller 17 to apply a pressure to the printing paper 2 on which the toner image is formed.

The toner image transferred by the image forming portions 11 through 14 is molten by the heat of the fixing roller 17, and penetrates the printing paper 2 by the pressure of the pressure roller 18, so that the toner image is fixed to the printing paper 2. The printing paper 2 to which the toner image is fixed is ejected from the image forming apparatus and is stacked in a not shown stacker.

The image forming apparatus constructed as above is capable of maintaining an excellent operating condition by attaching a toner container and the print process cartridge (described below) to the image forming apparatus.

Figure 2:
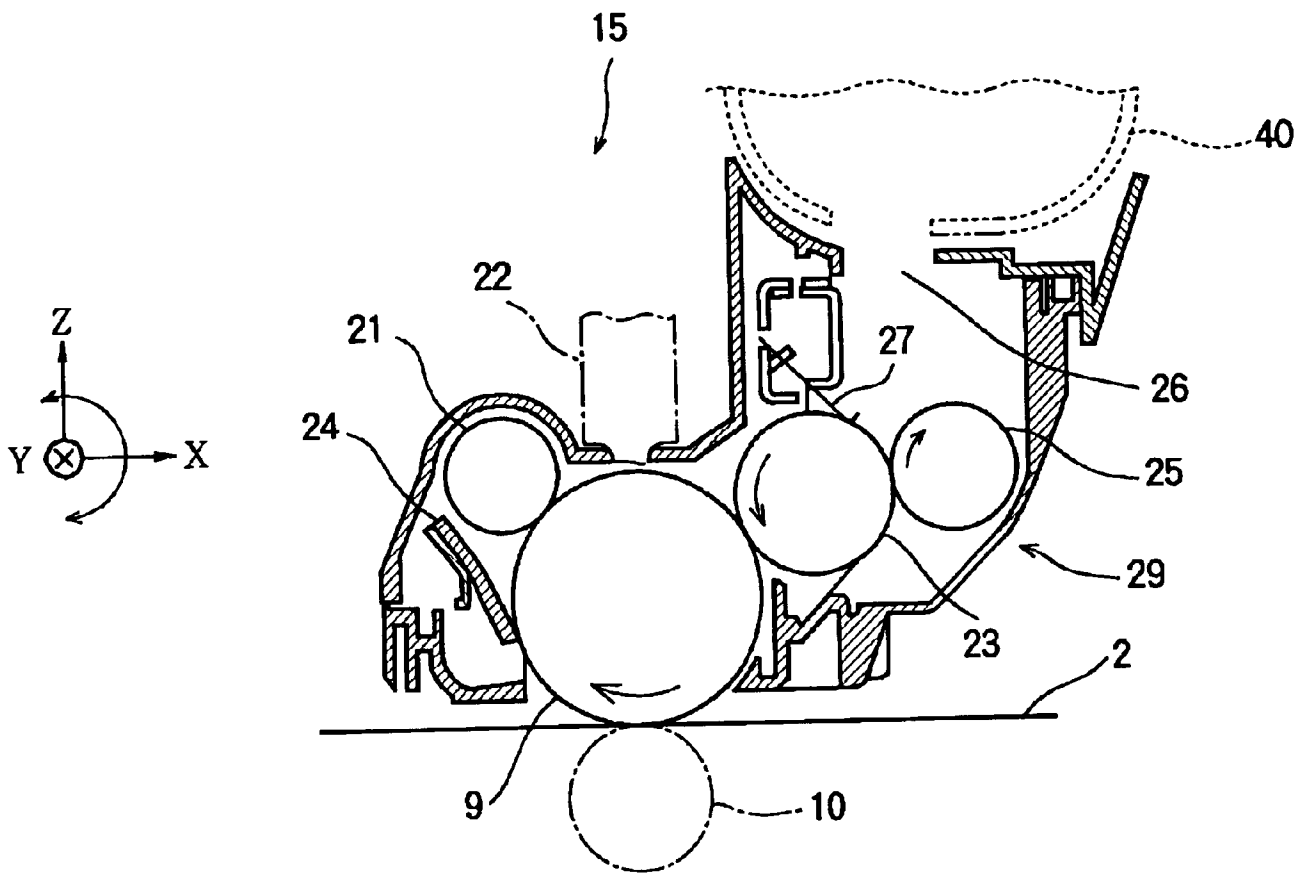
FIG. 2 is a sectional view of the main part of a print process cartridge according to Embodiment 1 of the present invention.

FIG. 2 is a sectional view illustrating the main part of the print process cartridge 15 according to Embodiment 1 of the present invention. The print process cartridge 15 shown in FIG. 2 corresponds to each of the print process cartridges 15 detachably attached to the image forming portions 11 through 14 of the image forming apparatus 1 (FIG. 1) according to Embodiment 1. The print process cartridge 15 is so constructed that a toner container 40 (described later) indicated by a dashed line in FIG. 2 is detachably attached to the print process cartridge 15.

In FIG. 2, the print process cartridge 15 is oriented in the orientation in which the print process cartridge 15 is attached to the image forming apparatus 1 shown in FIG. 1. X-axis, Y-axis and Z-axis in FIG. 2 are respectively the same as those in FIG. 1.

As shown in FIG. 2, the print process cartridge 15 includes the photosensitive drum 9 having the surface on which the image is formed. The photosensitive drum 9 is rotatably supported by a rotation shaft parallel to Y-axis. Along the circumference of the photosensitive drum 9, a charging roller 21, an exposing device 22, a developing roller 23, a transfer roller 10, and a cleaning blade 24 are disposed. The charging roller 21 uniformly charges the surface of the photosensitive drum 9. The exposing device 22 is provided on the body of the image forming apparatus 1 (FIG. 1), and exposes the surface of the photosensitive drum 9 to the light in accordance with the printing data, so that a latent image is formed on the surface of the photosensitive drum 9.

The developing roller 23 develops the latent image on the photosensitive drum 9 in such a manner that toner (i.e., developer) adheres to the latent image. The transfer roller 10 is provided on the body of the image forming apparatus 1. The transfer roller 10 is charged to have a polarity opposite to the toner, and transfers the toner from the photosensitive drum 9 to the printing paper 2. The cleaning blade 24 removes the toner that remains on the surface of the photosensitive drum 9 after the toner image is transferred to the printing paper 2.

The developing roller 23 is provided in a developing portion 29 of the print process cartridge 15. The developing portion 29 further includes a toner supplying roller 25 that contacts the developing roller 23. The toner supplying roller 25 receives the toner from the toner container 40 (described later) through an opening 26, and supplies the toner to a nip portion between the developing roller 23 and the toner supplying roller 25. Further, a blade 27 contacts the surface of the developing roller 23 so that a thin toner layer is uniformly formed on the developing roller 23.

Figure 3:
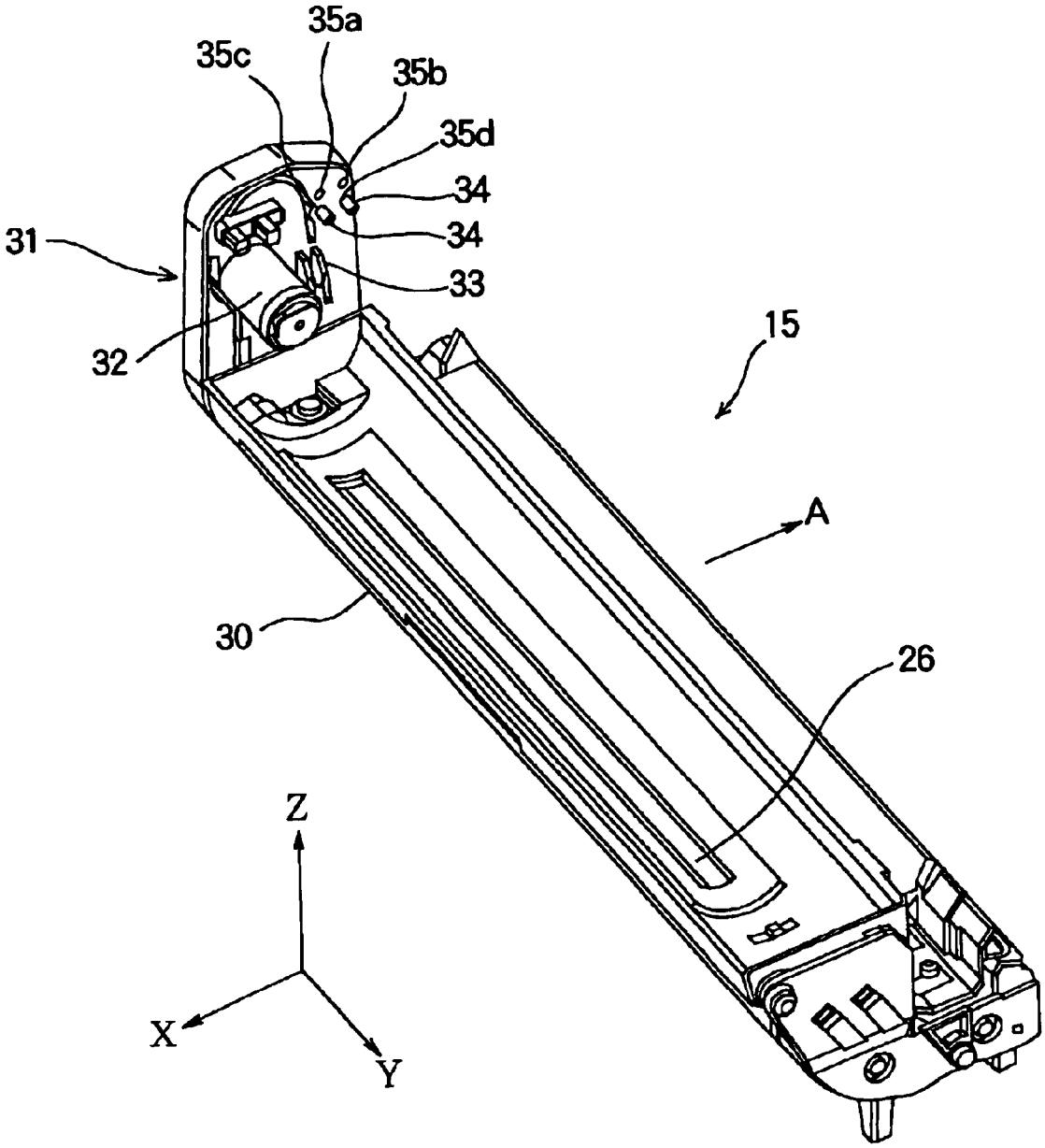
FIG. 3 is a top perspective view of the print process cartridge shown in FIG. 2.

FIG. 3 is a top perspective view illustrating the outer shape of the print process cartridge 15 shown in FIG. 2. X-axis, Y-axis and Z-axis shown in FIG. 3 are respectively the same as those in FIG. 2.

As shown in FIG. 3, the print process cartridge 15 includes a main body case 30 and an upright side wall 31 integrally formed with the main body case 30. The photosensitive drum 9, the charging roller 21, the developing roller 23, the cleaning blade 24, the toner supplying roller 25 or the like (FIG. 2) are disposed in the main body case 30.

A toner discharging mechanism 32 is provided on the side wall 31. The toner discharging mechanism 32 has a discharging opening through which waste toner is discharged so that the waste toner is accommodated in the toner container 40 (described later). Further, projections 33 are formed on the side wall 31. The toner discharging mechanism 32, the projection 33 and the opening 26 (FIG. 2) are respectively combined with predetermined parts of the toner container 40 when the toner container 40 is attached to the print process cartridge 15.

Selection grooves 35*a*, 35*b*, 35*c* and 35*d* are formed on the side wall 31 for selecting the toner container 40 to be attached to the print process cartridge 15 among four toner containers 40 corresponding to the colors of Y (yellow), M (magenta), C (cyan) and K (black). Two selection pieces 34 are inserted into two selection grooves (in FIG. 3, the selection grooves 35*c* and 35*d*) among four selection grooves 35*a*, 35*b*, 35*c* and 35*d* in accordance with the color of the toner or the specification of the toner container 40 to be attached to the print process cartridge 15.

With such an arrangement, the toner container 40 accommodating the toner of the desired color can be selectively attached to the print process cartridge 15. The components of the toner container 40 corresponding to the selection grooves 35*a*, 35*b*, 35*c* and 35*d* of the print process cartridge 15 are described later.

Figure 4:
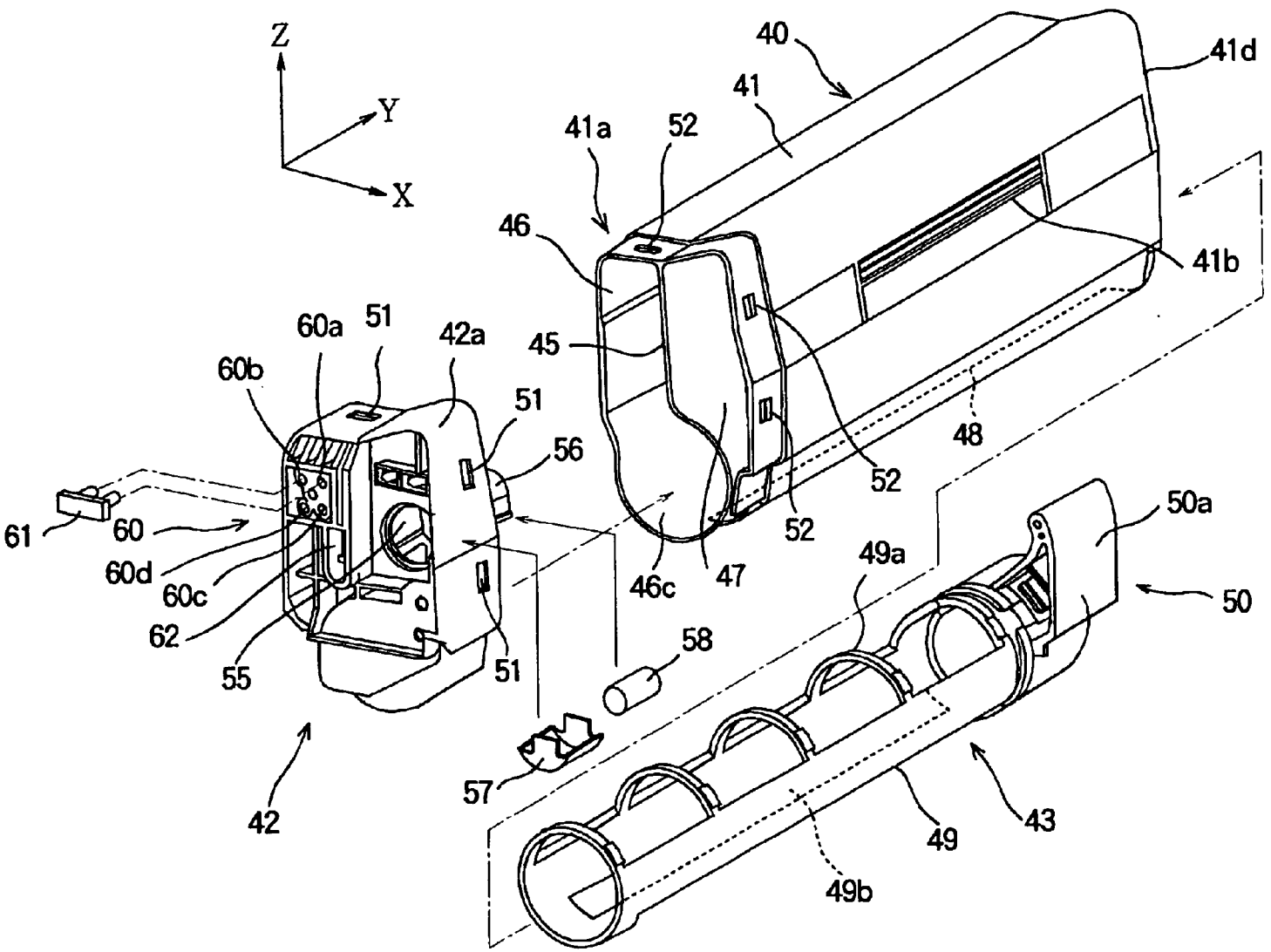
FIG. 4 is an exploded perspective view of the main part of a toner container (a developer container) according to Embodiment 1 of the present invention.

FIG. 4 is an exploded perspective view illustrating the main part of the toner container (i.e., a developer container) 40 according to Embodiment 1 of the present invention. The toner container 40 is detachably mounted in the image forming apparatus 1 shown in FIG. 1. To be more specific, the toner container 40 is detachably attached to the above described print process cartridge 15 (FIGS. 2 and 3) according to Embodiment 1.

In FIG. 4, the toner container 40 is oriented in the orientation when the toner container 40 is attached to the print process cartridge 15 shown in FIG. 2. X-axis, Y-axis and Z-axis in FIG. 2 are the same as those in FIGS. 1, 2 and 3.

As shown in FIG. 4, the toner container 40 includes a substantially cylindrical container body (i.e., a hollow elongated outer body) 41 in which fresh toner and waste toner are accommodated. The toner container 40 further includes a side cover 42 attached to an open side of the container body 41, and an opening-and-closing mechanism 43 provided on the container body 41.

Figure 5:
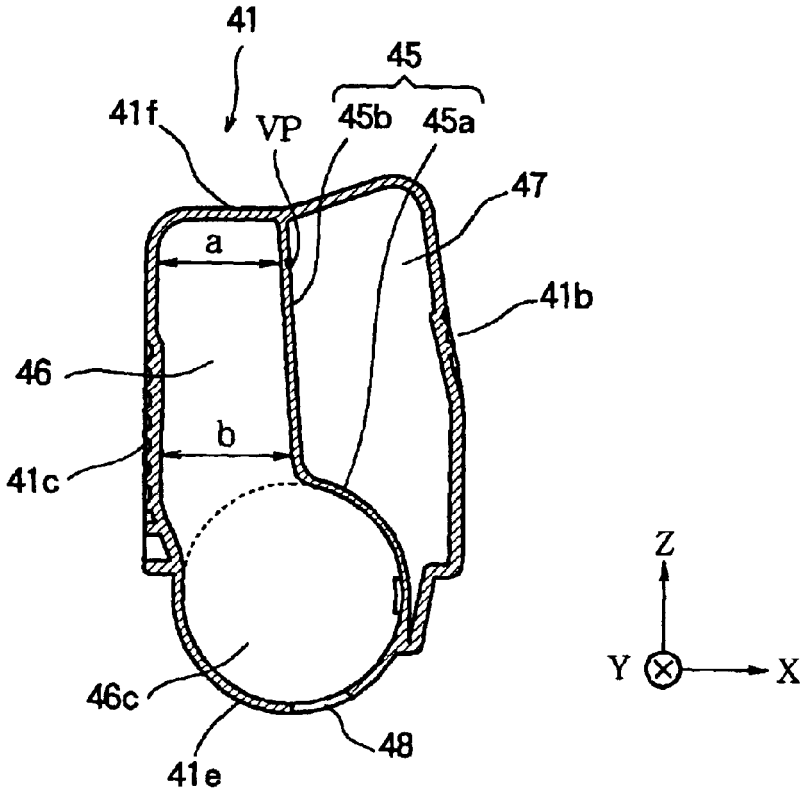
FIG. 5 is a sectional view of a substantially center portion of a container body of the toner container.

FIG. 5 is a sectional view of the substantially center portion of the container body 41. As shown in FIGS. 4 and 5, the container body 41 is divided by a partition wall 45 into a fresh toner chamber (a fresh developer accommodating portion) 46 and a waste toner chamber (a waste toner accommodating portion) 47. The fresh toner chamber 46 and the waste toner chamber 47 both extend in the longitudinal direction of the container body 41 so that the toner chambers 46 and 47 are adjacent to each other. The partition wall 45 extends downward from the center portion of the top wall 41*f* of the container body 41. An upper part 45*b* of the partition wall 45 straightly extend and slightly inclined with respect to Z-axis. A lower part 45*a* of the partition wall 45 is curved to have the cross section in the shape of a circular arc so that the lower part of the container body 41 is occupied by the fresh toner chamber 46 that has a space for inserting the opening-and-closing mechanism 43 having a circular cross section.

The bottom 41*e* of the container body 41 has a cross section in the shape of a circular arc having the same center of curvature as that of the lower part 45*a* of the partition wall 45 so that a cylindrical hollow portion 46*c* is formed in the lower part of the fresh toner chamber 46. A toner supply opening 48 is formed at the lowest position of the bottom 41*e* of the container body 41. The toner supply opening 48 is elongated in the longitudinal direction of the container body 41 (i.e., Y-axis). The toner supply opening 48 is aligned with the opening 26 (FIGS. 2 and 3) of the print process cartridge 15 when the toner container 40 is attached to the print process cartridge 15 shown in FIG. 2.

The shape of the fresh toner chamber 46 defined by the partition wall 45 will be described. As shown in FIG. 5, a width of the interior of the fresh toner chamber 46 along X-axis (i.e., in the horizontal direction substantially perpendicular to the longitudinal direction of the container body 41) at arbitrary vertical position VP along the partition wall 45 is referred to as a width "a". A corresponding width at another position (along the partition wall 45) below the arbitrary vertical position VP is referred to as a width "b". The shape of the fresh toner chamber 46 is so determined as to substantially satisfy the following relationship (1).

$$a \leqq b \tag{1}$$

In other words, the width "a" is substantially equal to or less than the width "b", and therefore the fresh toner chamber 46 has no narrow part which may be clogged with the fresh toner.

As shown in FIG. 4, the opening-and-closing mechanism 43 includes a rotatable cover 49 inserted into the hollow portion 46*c* of the fresh toner chamber 46 of the container body 41, and a rotating mechanism 50 provided outside the container body 41 for controlling the rotation of the rotatable cover 49. The rotating mechanism 50 has a lever 50*a*. The rotatable cover 49 is substantially in the shape of a cylinder whose upper half part is removed. Ring-shaped reinforcing portions 49*a* are formed on the upper half part of the rotatable cover 49. An opening 49*b* is formed at the lower half part of the rotatable cover 49. The opening 49*b* is elongated in the direction of Y-axis, i.e., the direction of the axis of the rotatable cover 49. The shape of the opening 49*b* is substantially the same as the toner supply opening 48 of the container body 41.

By operating the lever 50*a* in a state where the opening-and-closing mechanism 43 is attached to the container body 41, the rotatable cover 49 rotates about an axis parallel to Y-axis in the hollow portion 46*c*. The rotatable cover 49 rotates to switch between an opening-state in which the opening 49*b* is aligned with the toner supply opening 48 so that the toner supply opening 48 opens, and a closing-state in which the toner supply opening 48 is closed by the rotatable cover 49. When the rotatable cover 49 is in the opening-state, the fresh toner accommodated in the fresh toner chamber 46 is supplied to the developing portion 29 through the opening 26 of the print process cartridge 15 shown in FIG. 2.

The side cover 42 is attached to the container body 41 in such a manner that a peripheral wall 42*a* of the side cover 42 fits into an attachment portion 41*a* of the container body 41. The attachment portion 41*a* has fixing projections 52 fitting into fixing holes 51 of the peripheral wall 42*a* so as to determine the relative position of the side cover 42 with respect to the container body 41.

The side cover 42 has a waste toner collection opening (i.e., a collection opening) 55 through which the toner discharging mechanism 32 of the print process cartridge 15 (FIG. 3) enters into the waste toner chamber 47. A guide member 56 is formed on the side cover 42, and the guide member 56 extends from the vicinity of an upper periphery of the waste toner collection opening 55 to the interior of the waste toner chamber 47. A waste toner lid 57 is slidably supported by the guide member 56, and a resilient spring 58 urges the waste toner lid 57 toward the waste toner collection opening 55. The structure of the guide member 56, the waste toner lid 57 and the resilient spring 58 are described later.

The side cover 42 has an engaging portion 60 which engages two selection pieces 34 that have been inserted through the selection grooves 35*c* and 35*d* of the print process cartridge 15 shown in FIG. 3. The engaging portion 60 includes engaging holes 60*a*, 60*b*, 60*c* and 60*d* corresponding to the selection grooves 35*a*, 35*b*, 35*c* and 35*d* of the print process cartridge 15.

Among the engaging holes 60*a*, 60*b*, 60*c* and 60*d*, two engaging holes are selectively closed by a piece 61 in accordance with the color of the toner accommodated in the toner container 40. In FIG. 4, the engaging holes 60*a* and 60*b* are closed, and the engaging holes 60*c* and 60*d* remain opened. The engaging holes 60*c* and 60*d* receive the selection pieces 34 inserted through the selection holes 35*c* and 35*d* of the print process cartridge 15 shown in FIG. 3, when the toner container 40 is attached to the print process cartridge 15. Further, when the toner container 40 is attached to the print process cartridge 15, the protrusions 33 (FIG. 3) of the print process cartridge 15 fit into a recess 62 of the side cover 42, so as to ensure that the toner container 40 is correctly positioned with respect to the print process cartridge 15.

The container body 41 has non-slip portions 41*b* and 41*c* (FIG. 5) formed on outer surfaces of the side walls opposite to each other in X-direction. Each of the non-slip portions 41*b* and 41*c* has projections and depressions that prevent the toner container 40 from slipping when the toner container 40 is attached to or detached from the print process cartridge 15.

The toner container 40 is attached to the print process cartridge 15 shown in FIG. 3 in such a manner that the toner discharging mechanism 32, the projections 33 and the selection pieces 34 of the print process cartridge 15 respectively fit into the waste toner collection opening 55, the recess 62 and the engaging holes 60*c* and 60*d* of the toner container 40 (FIG. 4). The toner supply opening 48 of the toner container 40 is aligned with the opening 26 of the print process cartridge 15.

In this state, the toner discharging mechanism 32 conveys the waste toner into the waste toner chamber 47, and the waste toner is accommodated in the waste toner chamber 47. When the waste toner chamber 47 is filled with the waste toner, or when the fresh toner chamber 46 becomes empty, the toner container 40 is detached from the print process cartridge 15. As the toner discharging mechanism 32 (FIG. 3) is pulled out of the waste toner collection opening 55, the waste toner lid 57 closes the waste toner collection opening 55 from inside the waste toner chamber 47, so as to prevent the leakage of the waste toner.

According to the toner container 40 of Embodiment 1, the fresh toner chamber 46 has no narrow part which may be clogged with the fresh toner. Therefore, it is possible to supply all of the fresh toner accommodated in the fresh toner chamber 46 to the developing portion 29 through the toner supply opening 48.

Figure 6:
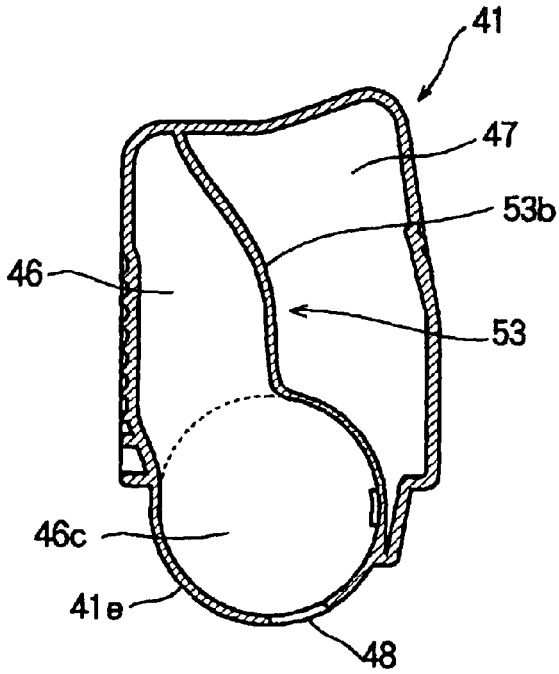
FIG. 6 is a sectional view of another example of the partition wall provided in the container body shown in FIG. 5.

In the container body 41 shown in FIG. 5, the upper part 45*b* of the partition wall 45 straightly extends. However, as shown in FIG. 6, it is possible that an upper part 53*b* of a partition wall 53 is curved so as to satisfy the above described relationship (1). With such an arrangement, the same advantage as that of the container body 41 shown in FIG. 5 can be obtained.

In the above described Embodiment 1, the shape of the partition wall 45 is so determined as to satisfy the relationship (1). However, even when the relationship (1) is not satisfied, it is possible that the upper part 45*b* of the partition wall 45 straightly extends and the angle of the inclination of the upper part 45*b* is so determined that the toner is easily released from the surface of the partition wall 45.

Embodiment 2.

Figure 7:
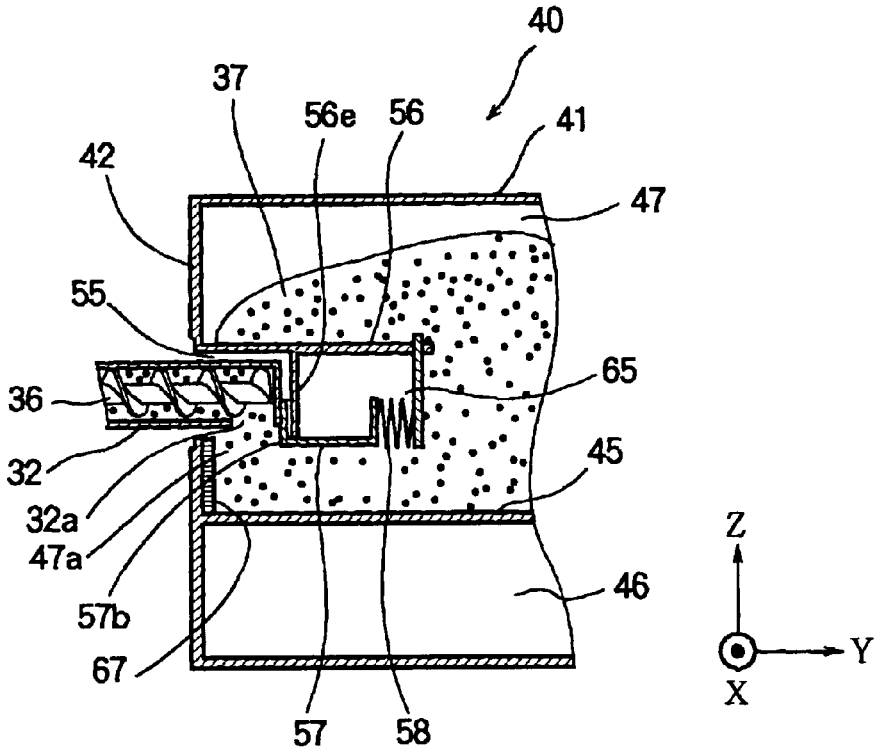
FIG. 7 is a sectional view of the main part of an opening-and-closing mechanism of a toner container (a developer container) according to Embodiment 2 of the present invention.
Figure 8:
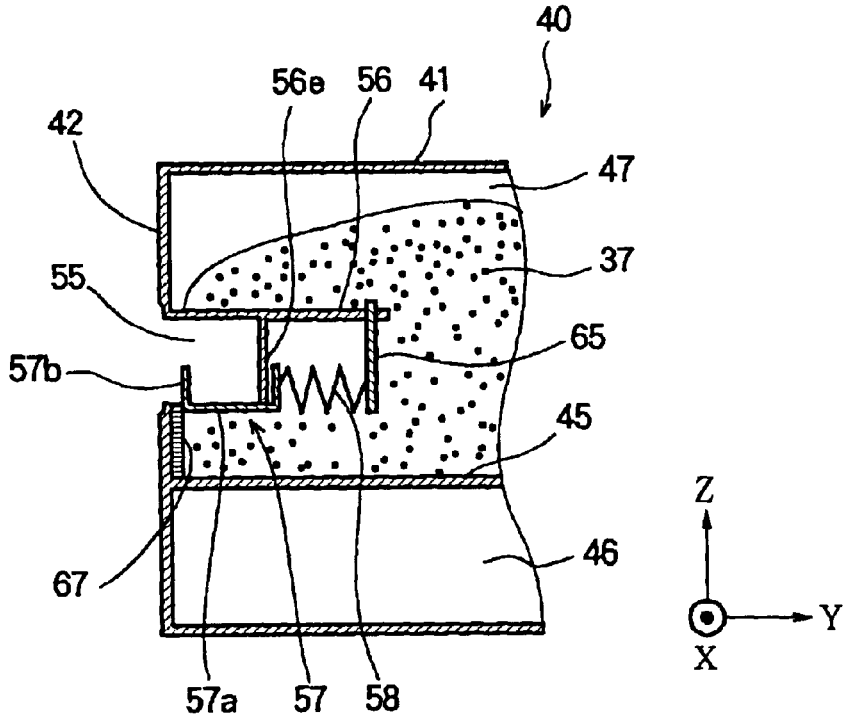
FIG. 8 is another sectional view of the main part of the opening-and-closing mechanism of the toner container according to Embodiment 2 of the present invention.

FIGS. 7 and 8 are sectional views illustrating the main part of an opening-and-closing mechanism of a toner container (i.e., a developer container) 40 according to Embodiment 2 of the present invention.

The opening-and-closing mechanism is provided for opening and closing the waste toner collection opening 55 of the toner container 40 described in Embodiment 1 (FIG. 4). In Embodiment 2, the components of the opening-and-closing mechanism of the toner container other than the components described below are the same as those in Embodiment 1, and therefore the drawings and the description thereof are omitted.

Figure 9A:
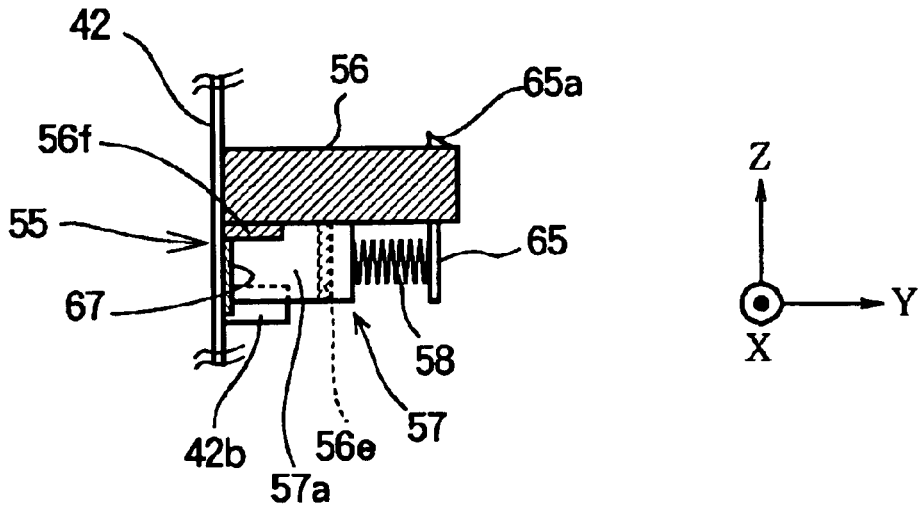
FIG. 9A is a side view of the opening-and-closing mechanism shown in FIG. 8 as seen from the positive side of X-axis.
Figure 9B:
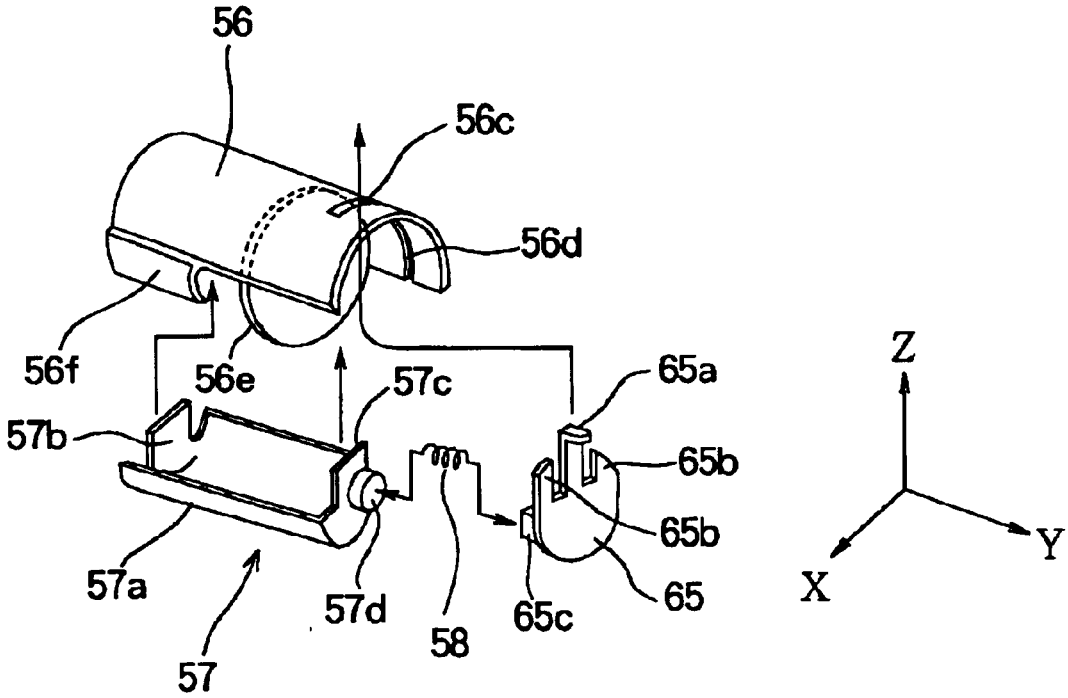
FIG. 9B is an exploded top perspective view of the opening-and-closing mechanism shown in FIG. 8.

FIG. 9A is a side view of the opening-and-closing mechanism shown in FIG. 8, as seen from the positive side of X-axis. FIG. 9B is an exploded top perspective view of the opening-and-closing mechanism shown in FIG. 8. In FIGS. 7 through 9B, X-axis, Y-axis and Z-axis are respectively the same as those in the FIGS. 1 through 6 of Embodiment 1.

As shown in FIGS. 7 through 9A, and as was described with reference to FIG. 4, the side cover 42 includes the waste toner collection opening 55 that opens to the interior of the waste toner chamber 47, and the guide member 56 that extends from the position above the waste toner collection opening 55 to the interior of the waste toner chamber 47. A sponge 67 is provided in the vicinity of the lower periphery of the waste toner collection opening 55.

As shown in FIG. 9B, the guide member 56 is substantially semicylindrical, i.e., in the shape of a cylindrical wall whose lower half part is removed. A positioning groove 56*d* and a fixing hole 56*c* are formed on the tip of the guide member 56 for fixing a stationary wall 65. A disk-shaped restricting plate 56*e* is formed on the intermediate portion of the guide member 56 so that the restricting plate 56*e* extends downward from the inner surface (i.e., the lower surface) of the guide member 56. A pair of lid guides 56*f* project downward from both circumferential ends of the guide member 56. Each lid guide 56*f* has a predetermined width and extends along Y-axis by a predetermined amount from the end of the guide member 56 facing the side cover 42. The lid guides 56*f* are inclined so that the distance between the lid guides 56*f* decreases along Z-axis toward the bottom ends of the lid guides 56*f*.

The waste toner lid (i.e., a waste developer lid) 57 includes a base portion 57*a* substantially in the shape of a semicylinder, i.e., in the shape of a cylindrical wall whose upper half part is removed. The radius of the cross section of the base portion 57*a* is smaller than that of the guide member 56. A shielding plate 57*b* and a holding plate 57*c* extend upward from both axial ends of the base portion 57*a*. The inner radius of the cross section of the base portion 57*a* is substantially the same as the outer radius of the restricting plate 56*e*.

Both sides of the base portion 57*a* are guided by the lid guides 56*f* of the guide member 56 in such a manner that the sides of the base portion 57*a* slide along the inner surfaces of the lid guides 56*f*. As shown in FIG. 9A, the bottom of the base portion 57*a* is guided by a bottom guide 42*b* extending from the side cover 42 to the interior of the waste toner chamber 47 so that the waste toner lid 57 is slidable along Y-axis. The restricting plate 56*e* of the guide member 56 is disposed between the shielding plate 57*b* and the holding plate 57*c*, and the peripheral end surface of the restricting plate 56*e* contacts the inner surface of the base portion 57*a* without a gap.

The stationary wall 65 has a fixing claw 65*a* that fits in the fixing hole 56*c* of the guide member 56, and a pair of shoulder portions 65*b* that fit in the positioning groove 56*d* of the guide member 56. The stationary wall 65 is attached to the tip of the guide member 56 so that the fixing claw 65*a* fits in the fixing hole 56*c* and the shoulder portions 56*b* fit in the positioning groove 56*d*.

Resilient spring holding portions 65*c* and 57*d* project from the facing surfaces of the stationary wall 65 and the holding plate 57*c* of the waste toner lid 57. The resilient spring 58 is supported by the resilient spring holding portions 65*c* and 57*d* so that the resilient spring 58 is compressed as shown in FIG. 9A. The waste toner lid 57 is urged by the resilient spring 58 in the negative direction of Y-axis, and therefore the end of the base portion 57*a* at the side of the shielding plate 57*b* abuts against the sponge 67 disposed in the vicinity of the lower periphery of the waste toner collection opening 55 so that the shielding plate 57*b* faces the outside of the waste toner chamber 47 through the waste toner collection opening 55.

In this state, the waste toner chamber 47 is sealed and shielded from outside by the waste toner lid 57. The sponge 67 improves the sealing performance and lessens the impact when the waste toner lid 57 abuts against the side cover 42 via the sponge 67.

In FIG. 7, the toner container 40 having the above described opening-and-closing mechanism is attached to the print process cartridge 15 (FIG. 3).

As shown in FIG. 7, the tip of the toner discharging mechanism 32 of the print process cartridge 15 (FIG. 3) urges the waste toner lid 57 in the positive direction of Y-axis overcoming the force of the resilient spring 58, and enters into the waste toner chamber 47 through the waste toner collection opening 55. As the waste toner lid 57 moves in the positive direction of Y-axis, an opening 47*a* is formed between the side cover 42 and the shielding plate 57*b*. The opening 47*a* is covered by the guide member 56 from above.

A screw conveyor 36 is provided in the toner discharging mechanism 32. The screw conveyor 36 conveys the waste toner to the tip of the toner discharging mechanism 32, and discharges the waste toner through a discharging opening (i.e., a waste developer discharging opening) 32*a* formed at the tip of the toner discharging mechanism 32. In a state where the tip of the toner discharging mechanism 32 has entered into the waste toner chamber 47, the discharging opening 32*a* is aligned with the opening 47*a* and therefore the waste toner 37 discharged out of the discharging opening 32*a* falls in the interior of the waste toner chamber 47 as shown in FIG. 7.

When the waste toner chamber 47 is filled with the waste toner 37, or when the fresh toner chamber 46 becomes empty, the toner container 40 is detached from the print process cartridge 15 (FIG. 3). As the toner discharging mechanism 32 is pulled out through the waste toner collection opening 55, the waste toner lid 57 moves in the negative direction of Y-axis, and closes the opening 47*a* to seal the waste toner chamber 47 as shown in FIG. 8 so as to prevent the leakage of the waste toner 37.

As described above, according to the toner container 40 including the opening-and-closing mechanism of Embodiment 2, the semicylindrical guide member 56 covers the toner discharging mechanism 32 (that has entered into the waste toner chamber 47 through the waste toner collection opening 55) from above. Thus, the guide member 56 prevents the waste toner 37 from falling on the toner discharging mechanism 32. Accordingly, the waste toner 37 does not leak out of the waste toner chamber 47 even when the toner discharging mechanism 32 is pulled out of the waste toner chamber 47.

Figure 10:
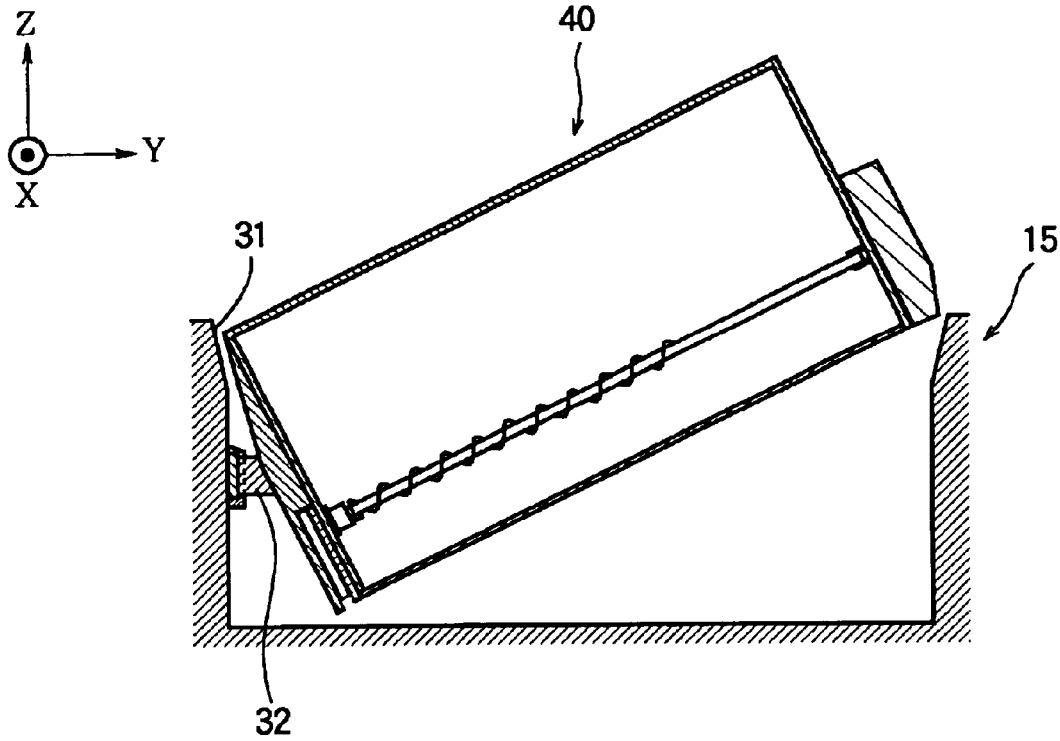
FIG. 10 is a schematic view of the toner container in a state where the toner container is inclined during the detachment process of the toner container.

Additionally, as shown in FIG. 10, when the toner container 40 is inclined during the process in which the toner container 40 is detached from the print process cartridge 15, the waste toner 37 accommodated in the upper part of the waste toner chamber 47 may easily lose its balance and a large amount of the waste toner 37 may fall from the upper part of the waste toner chamber 47. However, because the waste toner collection opening 55 is surrounded by the guide member 56 and the restricting plate 56*e*, the waste toner 37 does not reach the waste toner collection opening 55. Thus, it becomes possible to prevent the leakage of the waste toner 37 out of the waste toner chamber 47 even when the toner container 40 is detached from the print process cartridge 15.

Embodiment 3.

Figure 11:
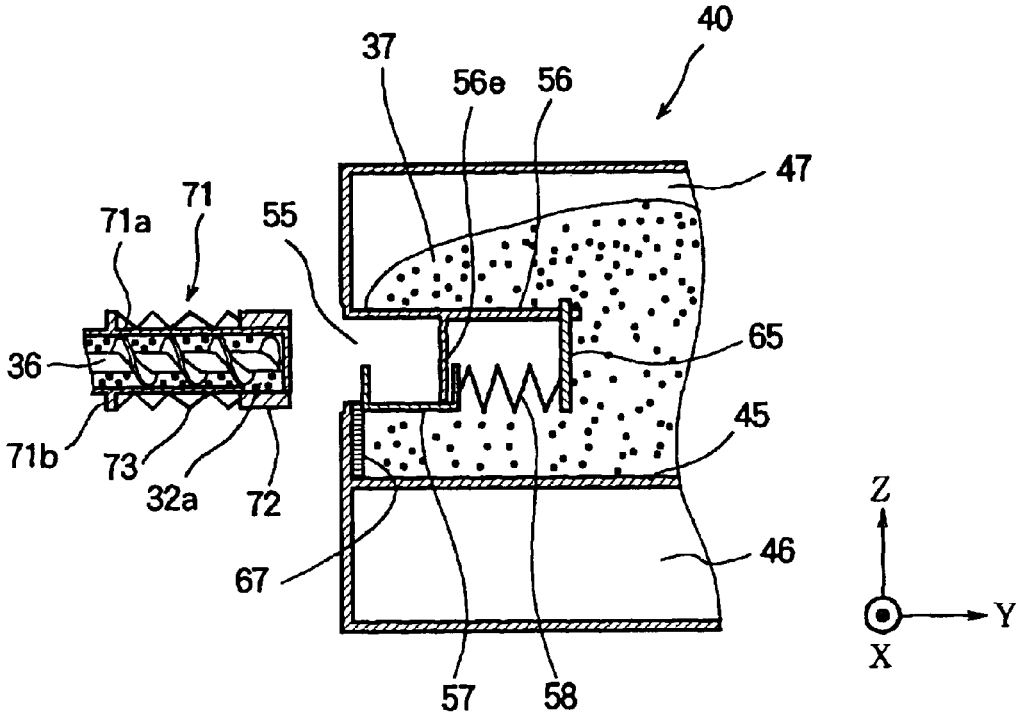
FIG. 11 is a sectional view of the main part of a toner discharging mechanism of a print process cartridge according to Embodiment 3 of the present invention.
Figure 12:
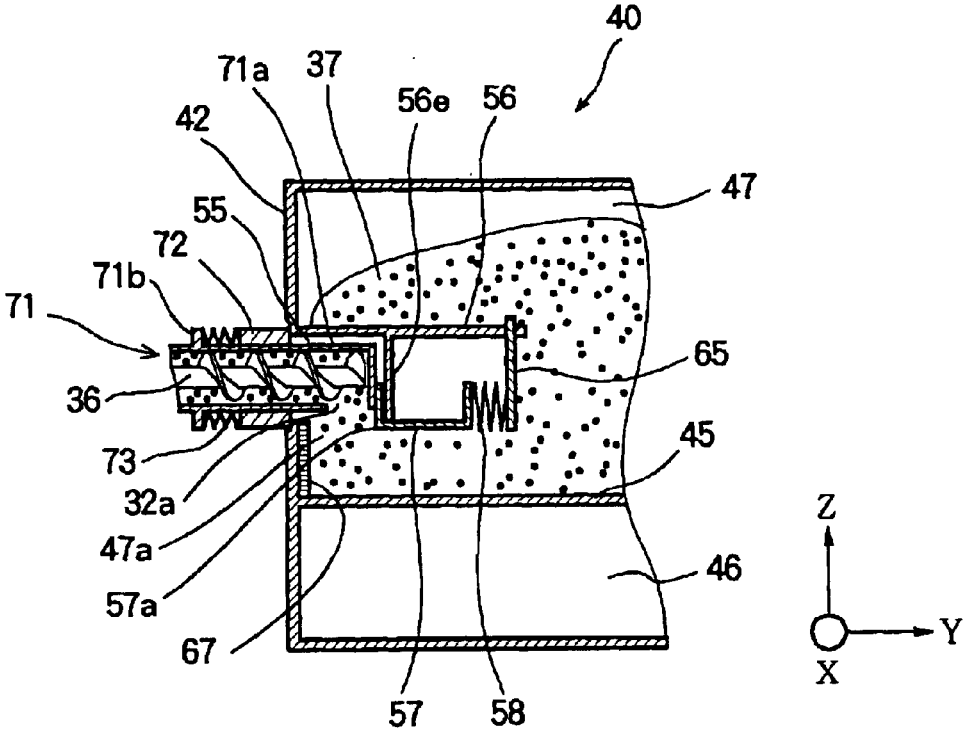
FIG. 12 is another sectional view of the main part of the toner discharging mechanism of the print process cartridge according to Embodiment 3 of the present invention.

FIGS. 11 and 12 are sectional views of the main part of a toner discharging mechanism 71 according to Embodiment 3 of the present invention.

The toner discharging mechanism 71 replaces the toner discharging mechanism (for example, the toner discharging mechanism 32 shown in FIG. 7) according to previously described Embodiments 1 and 2. The toner discharging mechanism 71 is different from the toner discharging mechanism 32 (FIG. 7) in that the toner discharging mechanism 71 has a discharging lid 72 in addition to the components of the toner discharging mechanism 32 (FIG. 7). Components similar to those of the toner discharging mechanism 32 (FIG. 7) have been given the same reference numerals. The description of the toner discharging mechanism 71 is emphasized on the differences from the toner discharging mechanism 32. Reference will be made to FIGS. 2 and 3 showing the print process cartridge 15 according to Embodiment 1 as necessary.

FIG. 11 illustrates the toner discharging mechanism 71 and the toner container 40 in a state where the toner container 40 is not yet attached to the print process cartridge 15 (FIG. 3). In this state, the toner discharging mechanism 71 is apart from the waste toner collection opening 55.

As shown in FIG. 11, the toner discharging mechanism 71 includes a cylindrical portion 71*a*. The tip of the cylindrical portion 71*a* is in the shape of a cylinder having a closed end. The screw conveyor 36 is provided in the cylindrical portion 71*a*, and conveys the waste toner to the tip of the cylindrical portion 71*a* to discharge the waste toner through the discharging opening 32*a* so that the waste toner falls from the discharging opening 32*a*. A projecting rim 71*b* is formed on the outer surface of the cylindrical portion 71*a*, and extends along the circumference of the cylindrical portion 71*a*. The projecting rim 71*b* is formed on the position distanced from the tip of the cylindrical portion 71*a* by a certain amount.

The discharging lid 72 is in the shape of a ring. The discharging lid 72 has such an inner diameter that the discharging lid 72 slidably fits around the cylindrical portion 71*a*. The discharging lid 72 has a sufficient width for closing the discharging opening 32*a*. A coil spring 73 is provided between the projecting rim 71*b* and the discharging lid 72 so that the coil spring 73 is compressed. The coil spring 73 urges the discharging lid 72 in the positive direction of Y-axis. The movement of the discharging lid 72 in the positive direction of Y-axis is restricted by a not shown restricting member so that the discharging lid 72 is retained at a closing position (in the vicinity of the tip of the cylindrical portion 71*a*) where the discharging lid 72 closes the discharging opening 32*a*.

FIG. 12 illustrates the toner discharging mechanism 71 and the toner container 40 in a state where the toner container 40 is attached to the print process cartridge 15 (FIG. 3).

When the cylindrical portion 71*a* of the toner discharging mechanism 71 enters into the waste toner chamber 47 through the waste toner collection opening 55, the cylindrical portion 71*a* urges the waste toner lid 57 in positive direction of Y-axis overcoming the force of the resilient spring 58 as described above. In the waste toner chamber 47, an opening 47*a* is formed between the side cover 42 and the shielding plate 57*b*. The opening 47*a* is covered by the guide member 56 from above.

The ring-shaped discharging lid 72 of the toner discharging mechanism 71 abuts against a peripheral portion around the waste toner collection opening 55 and does not enter into the waste toner chamber 47. Thus, the discharging lid 72 relatively moves in the negative direction of Y-axis along the cylindrical portion 71*a* overcoming the force of the coil spring 73 so as to open the discharging opening 32*a* of the cylindrical portion 71*a*.

Therefore, the discharging opening 32*a* is aligned with the opening 47*a* in the waste toner chamber 47, so that the waste toner 37 falls in the interior of the waste toner chamber 47 through the discharging opening 32*a* as shown in FIG. 12.

When the waste toner chamber 47 is filled with the waste toner, or when the fresh toner chamber 46 becomes empty, the toner container 40 is detached from the print process cartridge 15. When the cylindrical portion 71*a* of the toner discharging mechanism 71 is pulled out of the waste toner collection opening 55, the discharging lid 72 moves in the positive direction of Y-axis relatively to the cylindrical portion 71*a* by the force of the coil spring 73, and reaches the closing position where the discharging lid 72 closes the discharging opening 32*a* as shown in FIG. 11. Thus, the waste toner does not leak out of the toner discharging mechanism 71.

As described above, according to the toner discharging mechanism 71 of Embodiment 3, the discharging lid 72 opens the discharging opening 32*a* when the discharging opening 32*a* is in the waste toner chamber 47, and the discharging lid 72 closes the discharging opening 32*a* when the discharging opening 32*a* is out of the waste toner chamber 47. Therefore, when the toner container 40 is attached to or detached from the print process cartridge 15, and after the toner container 40 is detached from the print process cartridge 15, it becomes possible to prevent the leakage of the waste toner 37 out of the toner discharging mechanism 71.

Embodiment 4.

Figure 13:
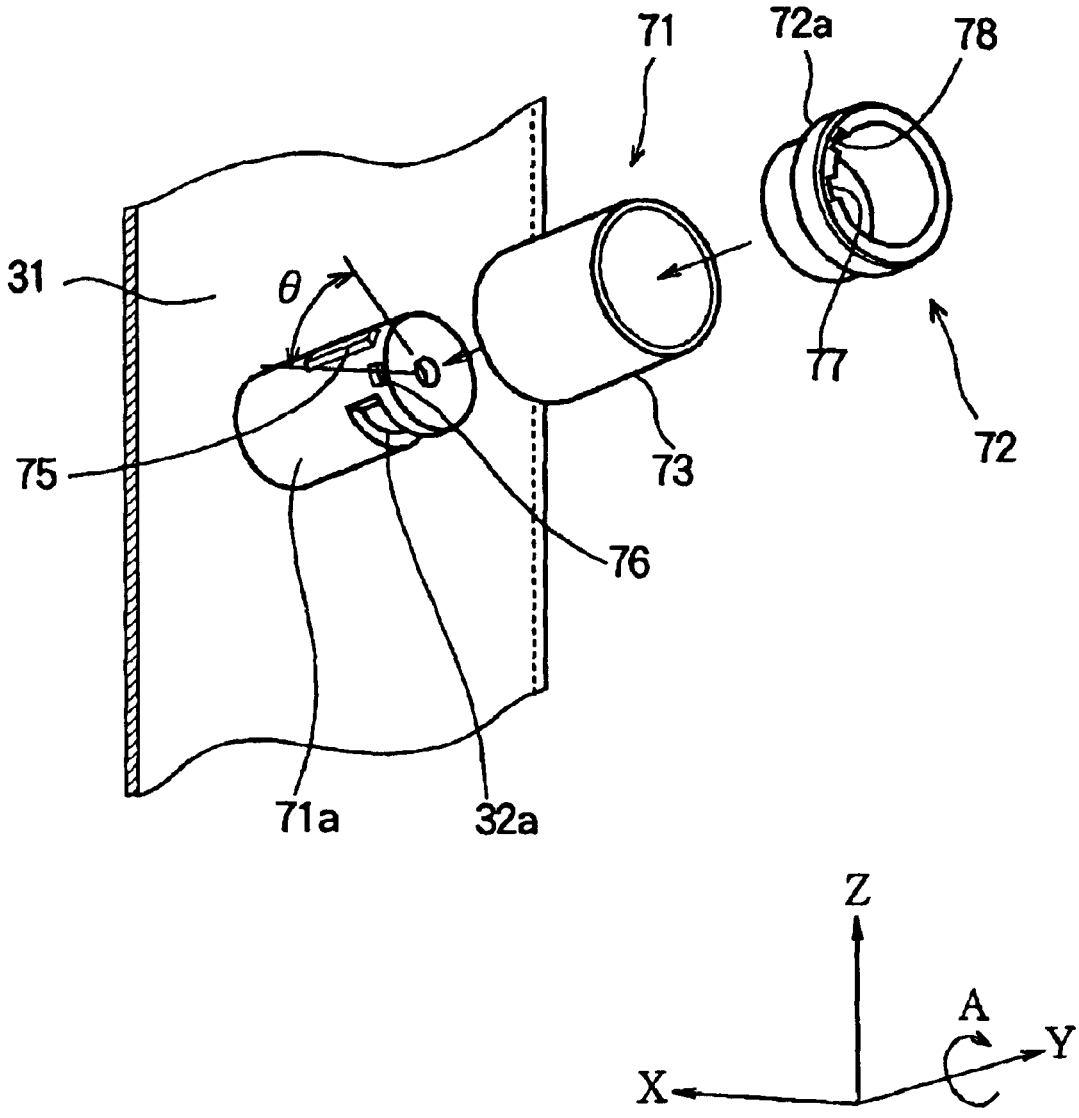
FIG. 13 is an exploded perspective view of the main part of a toner discharging mechanism of a print process cartridge according to Embodiment 4 of the present invention.

FIG. 13 is an exploded perspective view illustrating the main part of a toner discharging mechanism 32 according to Embodiment 4 of the present invention.

Embodiment 4 discloses the detailed structure of the opening-and-closing mechanism for the discharging opening 32*a* of the toner discharging mechanism 71 according to Embodiment 3 that has been described with reference to FIGS. 11 and 12. The components of the toner discharging mechanism 71 other than the components described below are the same as those in Embodiment 3, and therefore the drawings and the description thereof are omitted. Reference will be made to FIGS. 11 and 12 showing the toner discharging mechanism 71 according to Embodiment 3 as necessary.

FIG. 13 is an exploded bottom perspective view of the tip of the toner discharging mechanism 71. In FIG. 13, X-axis, Y-axis and Z-axis are the same as those in FIGS. 1 through 12 of the previously described Embodiments.

The side wall 31 shown in FIG. 13 corresponds to the side wall 31 of the print process cartridge 15 shown in FIG. 3. The cylindrical portion 71*a* of the toner discharging mechanism 71 projects from the side wall 31. In Embodiment 4, the side wall 31 has a function of restricting the position of one end of the coil spring 73 as described later. This function has been performed by the projecting rim 71*b* (FIGS. 11 and 12) in Embodiment 3.

As was described in Embodiment 3, the toner discharging mechanism 71 includes the screw conveyor 36 (FIG. 12) provided in the cylindrical portion 71*a*. The screw conveyor 36 conveys the waste toner to the tip of the cylindrical portion 71*a* and discharges the waste toner so that the waste toner falls from the discharging opening 32*a* formed at the tip of the cylindrical portion 71*a*. A movement-restricting rib 75 is formed on the outer surface of the cylindrical portion 71*a*. The movement-restricting rib 75 extends from the tip of the cylindrical portion 71*a* in the negative direction of Y-axis (i.e., in the direction substantially parallel to the cylindrical portion 71*a*) by a predetermined amount. A guide projection 76 is formed on the outer surface of the cylindrical portion 71*a* and is disposed at the tip of the cylindrical portion 71*a*. The rotational positions of the guide projection 76 and the movement-restricting rib 75 about an axis of the cylindrical portion 71*a* are apart from each other by a certain angle θ.

Figure 14A:
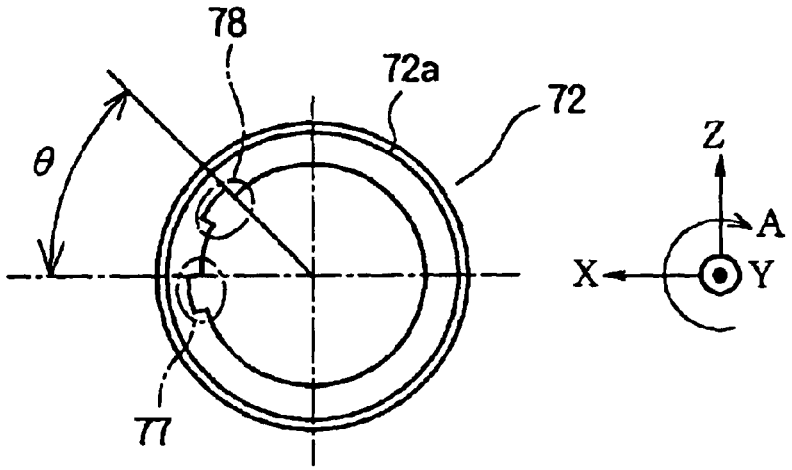
FIG. 14A is a front view of a discharging lid as seen from the positive side of Y-axis for illustrating a method for assembling the toner discharging mechanism shown in FIG. 13.
Figure 14B:
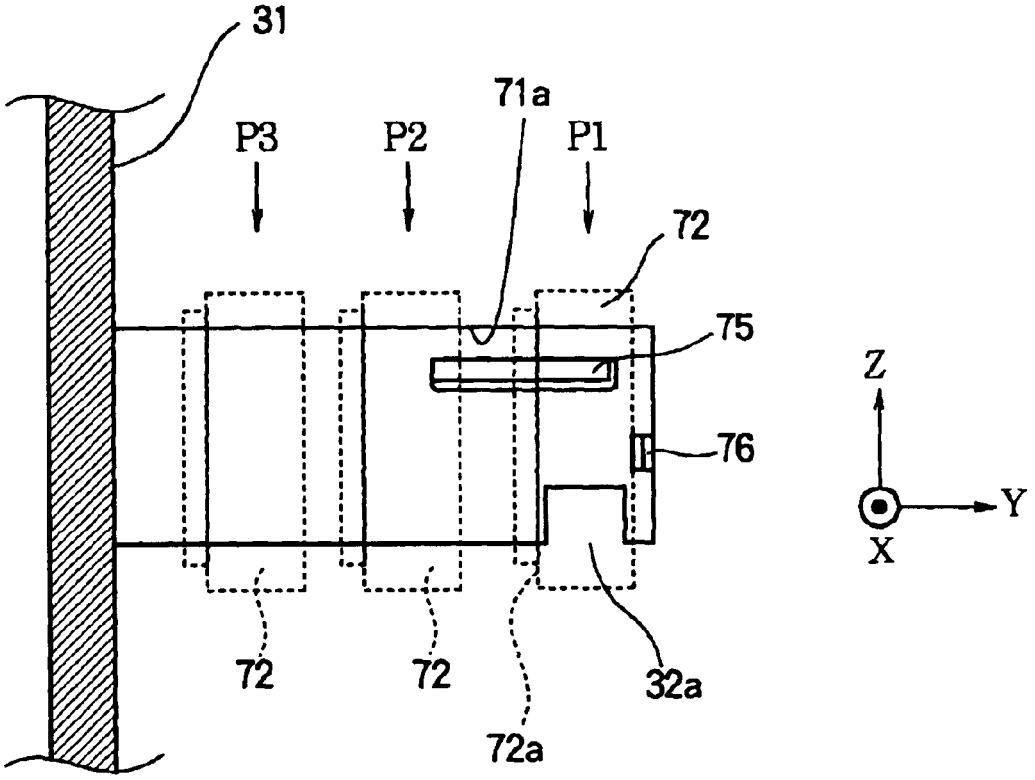
FIG. 14B is a side view of a cylindrical portion as seen from the positive side of X-axis for illustrating the method for assembling the toner discharging mechanism shown in FIG. 13.

FIGS. 14A and 14B illustrate the process for attaching the discharging lid 72 to the cylindrical portion 71*a*. FIG. 14A is a front view of the discharging lid 72 as seen from the positive side of Y-axis. FIG. 14B is a side view of the cylindrical portion 71*a* as seen from the positive side of X-axis.

As shown in FIGS. 13 and 14A, the discharging lid 72 includes a larger part having a larger outer diameter and a smaller part having a smaller outer diameter. A step portion 72*a* is formed between the larger and smaller parts of the discharging lid 72. A first guide groove 77 and a second guide groove 78 are formed on the inner surface of the discharging lid 72. The first and second guide grooves 77 and 78 extend along Y-axis (i.e., in the direction substantially parallel to the cylindrical portion 71*a*). As shown in FIG. 14A, the rotational positions of the first and second guide grooves 77 and 78 about the axis of the cylindrical portion 71*a* are apart from each other by the same angle θ as that between the guide projection 76 and the movement-restricting rib 75.

When the opening-and-closing mechanism for the discharging opening 32*a* is to be assembled, the coil spring 73 is fitted around the cylindrical portion 71*a* with a play formed between the coil spring 73 and the cylindrical portion 71*a*. Then, the discharging lid 72 is fitted around the cylindrical portion 71*a* by sliding the discharging lid 72 in the negative direction of Y-axis.

When the discharging lid 72 is fitted around the cylindrical portion 71*a*, the guide projection 76 of the cylindrical portion 71*a* engages the first guide groove 77 of the discharging lid 72, and the movement-restricting rib 75 engages the second guide groove 78. The coil spring 73 is compressed by the side wall 31 and the step portion 72*a* of the discharging lid 72.

Then, as shown by dashed line in FIG. 14B, the discharging lid 72 is slid to the position P3 where the guide projection 76 moves out of the first guide grooves 77 and the movement-restricting rib 75 moves out of the second guide groove 78. In FIG. 14B, the coil spring 73 is omitted for simplicity.

In this position P3, the discharging lid 72 is rotated in the direction denoted by "A" (FIG. 14A) by the angle θ about an axis parallel to Y-axis so that the first guide groove 77 is able to engage the movement-restricting rib 75. Then, the discharging lid 72 is moved in the positive direction of Y-axis so that the first guide groove 77 engages the movement-restricting rib 75 to guide the discharging lid 72 along Y-axis.

When the end surface at the positive side of Y-axis of the discharging lid 72 abuts against the guide projection 76 so as to restrict the movement of the discharging lid 72, the discharging lid 72 stops at the position P1 shown in FIG. 14B. In this state, the discharging lid 72 closes the discharging opening 32*a* of the cylindrical portion 71*a*, and is urged toward the tip of the cylindrical portion 71*a*. The position P1 is referred to as a closing position.

In this state, when the toner container 40 (FIG. 12) is attached to the print process cartridge 15, the tip of the cylindrical portion 71*a* including the discharging opening 32*a* enters into the waste toner chamber 47 through the waste toner collection opening 55. Further, the discharging lid 72 is urged by the peripheral portion around the waste toner collection opening 55 of the side cover 42 and relatively moves in the negative direction of Y-axis along the cylindrical portion 71*a* so that the discharging lid 72 stops at the position P2 (i.e., an opening position) shown in FIG. 14B.

The discharging of the waste toner and the attachment and detachment of the toner container 40 are performed as described in Embodiment 3, and therefore the description thereof is omitted.

As described above, according to the opening-and-closing mechanism for the discharging opening 32*a* of the toner discharging mechanism 71 of Embodiment 4, the same advantages as those of Embodiment 3 can be obtained. Additionally, the assembling of the opening-and-closing mechanism can be simplified, for example, even when the direction in which the discharging lid 72 can be attached to the cylindrical portion 71*a* is limited to the negative direction of Y-axis. So long as the movement-restricting rib 75 and the guide projection 76 are formed on the cylindrical portion 71*a*, and the guide grooves 77 and 78 are formed on the discharging lid 72, it is not necessary to use separate parts for assembling the opening-and-closing mechanism.

Embodiment 5.

Figure 15:
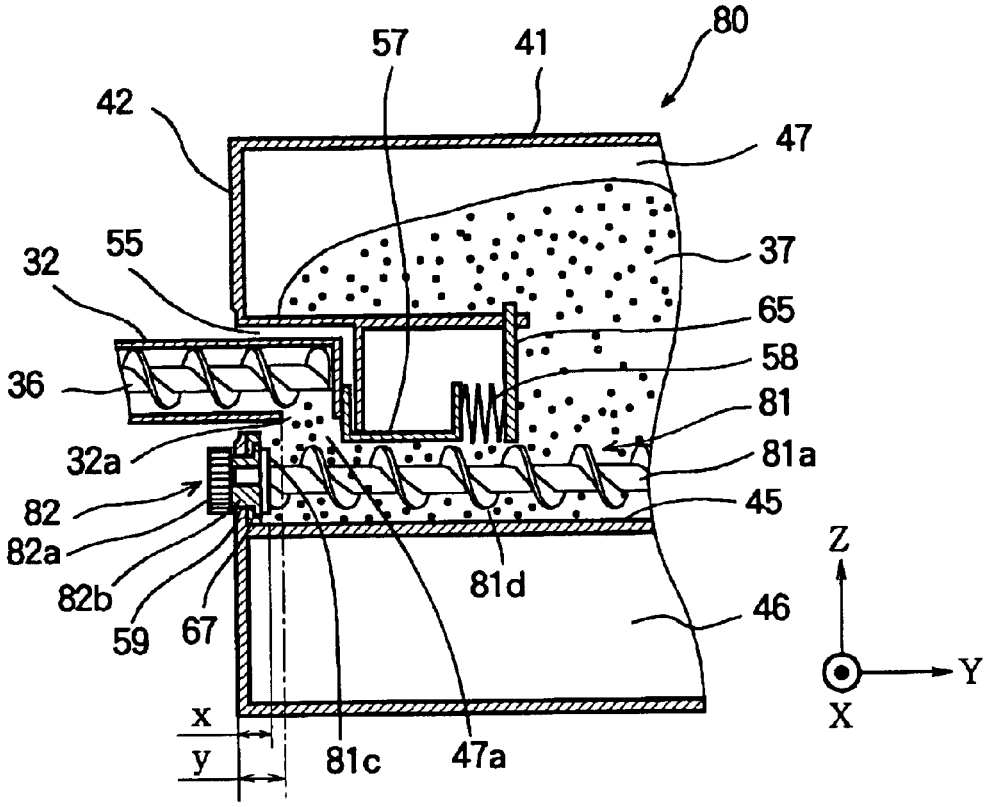
FIG. 15 is a sectional view of the main part of a developer container according to Embodiment 5 of the present invention.

FIG. 15 is a sectional view illustrating the main part of a toner container (i.e., a developer container) 80 according to Embodiment 5 of the present invention. The toner container 80 is detachably attached to the print process cartridge 15 (FIGS. 2 and 3) according to Embodiment 1. The toner container 80 replaces, for example, the toner container 40 (FIG. 4) according to Embodiment 1.

The toner container 80 is different from the toner container 40 in that the toner container 80 has another screw conveyor (i.e., a developer conveyor) 81 and additional components associated with the screw conveyor 81 in the waste toner chamber 47. In Embodiment 5, components similar to those of the toner container 40 (FIG. 4) have been given the same reference numerals, or the drawings and the description thereof are omitted. The description of the toner container 80 is emphasized on the differences from the toner container 40. Reference will be made to the drawings showing the toner container 40 according to Embodiment 1 as necessary.

As shown in FIG. 15, the screw conveyor 81 extends from the position below the opening 47*a* in the longitudinal direction (Y-axis) of the container body 41. Both ends of a shaft of the screw conveyor 81 are rotatably supported by the side cover 42 and the opposite side 41*d* (FIG. 4) of the container body 41. At the side cover 42, one end portion 81*b* (FIG. 16A) of the shaft of the screw conveyor 81 is held by a conveying gear 82 rotatably supported by the side cover 42.

Figure 16A:
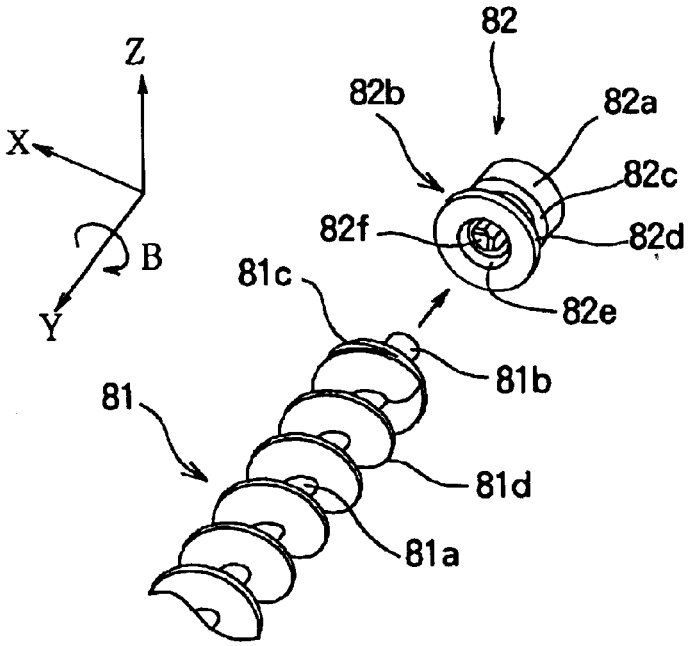
FIG. 16A is a perspective view illustrating the combination of a screw conveyor and a conveying gear.
Figure 16B:
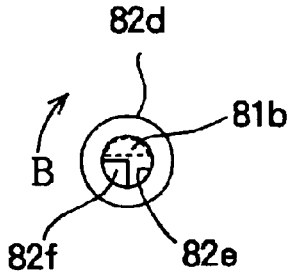
FIG. 16B is a front view of the conveying gear as seen from the positive side of Y-direction.

FIG. 16A is an exploded perspective view illustrating the combination of the screw conveyor 81 and the conveying gear 82. FIG. 16B is a front view of the conveying gear 81 as seen from the positive side of Y-axis. In FIGS. 15, 16A and 16B, X-axis, Y-axis and Z-axis are the same as those in the FIGS. 1 through 14 of the previously described Embodiments.

As shown in FIG. 16B, the conveying gear 82 has a gear portion 82*a* and a boss portion 82*b*. The boss portion 82*b* includes a shaft portion 82*c* (having the outer diameter smaller than that of the gear portion 82*a*), a flange portion 82*d*, and a holding hole 82*e* that holds the end portion 81*b* of the shaft of the screw conveyor 81. The conveying gear 82 is supported by a supporting hole 59 (FIG. 15) formed on the side cover 42 below the waste toner collection opening 55. The gear portion 82*a* and the flange portion 82*d* restrict the axial movement (i.e., the movement along Y-axis) of the conveying gear 82. The sponge 67 is attached to the inner surface of the side cover 42 besides the waste toner collection opening 55 so as to lessen the impact between the flange portion 82*d* and the sponge 67 when the conveying gear 82 moves in the negative direction of Y-axis.

As shown in FIGS. 16A and 16B, an engaging projection 82*f* is formed in the holding hole 82*e* of the conveying gear 82. As shown in FIG. 16B, the cross section of the engaging projection 82*f* (in a plane perpendicular to Y-axis) is in the shape of a sector having the central angle of 90 degrees and having the center aligned on the center of the holding hole 82*e*. The cross section of the end portion 81*b* of the screw conveyor 81 (in a plane perpendicular to Y-axis) is in the shape of a semicircle. The end portion 81*b* of the shaft of the screw conveyor 81 can be easily inserted into the holding hole 82*e* so that a play is formed and the end portion 81*b* is able to rotate by 90 degree (i.e., one forth of one rotation) in the holding hole 82*e*.

The screw conveyor 81 is driven by a not shown rotation mechanism that engages the gear portion 82*a* of the conveying gear 82, and rotates in the direction indicated by an arrow B about an axis parallel to Y-axis. In the holding hole 82*e*, the engaging projection 82*f* and the end portion 81*b* engage each other as shown in FIG. 16B so that the rotation of the conveying gear 82 is transmitted to the screw conveyor 81.

The operation of the above described construction will be described.

As was described in Embodiment 2 with reference to FIGS. 7 and 8, the tip of the toner discharging mechanism 32 urges the waste toner lid 57 in the positive direction of Y-axis and enters into the waste toner chamber 47 through the waste toner collection opening 55 causing the opening 47*a* to be formed in the waste toner chamber 47. The toner discharging mechanism 32 conveys the waste toner by means of the screw conveyor 36 and discharges the waste toner through the discharging opening 32*a*, so that the discharged waste toner falls in the interior of the waste toner chamber 47 through the opening 47*a*.

The distance "y" represents the distance from the outer surface of the side cover 42 to the discharging opening 32*a*. The distance "x" represents the distance form the outer surface of the side cover 42 to the nearest end of a helical blade 81*d* formed on the screw conveyor 81 in the waste toner chamber 47. The distances "x" and "y" satisfy the following relationship (2):

$$x \leqq y \quad (2)$$

With such an arrangement, the position of the discharging opening 32*a* along X-axis is aligned with a portion where the helical blade 81*d* is formed on the screw conveyor 81. Therefore, it is ensured that the waste toner 37 discharged from the discharging opening 32*a* is conveyed by the screw conveyor 81. The waste toner 37 is conveyed in the positive direction of Y-axis as the screw conveyor 81 rotates in the direction indicated by B (FIG. 16A) so that the waste toner 37 is uniformly accumulated in the interior of the waste toner chamber 47.

As described above, according to the toner container 80 of Embodiment 5, all of the waste toner 37 discharged from the toner discharging mechanism 32 can be conveyed by the screw conveyor 81. Therefore, it is possible to prevent the non-uniform accumulation (such as a concentration) of the waste toner 37 in the waste toner chamber 47. As a result, it is possible to prevent the clogging and the agglomeration of the waste toner 37. Further, it is possible to efficiently collect the waste toner 37 without applying a excessively large force to the screw conveyor 81.

In addition, the conveying gear 82 has a structure in which the gear portion 82*a* and the boss portion 82*b* are integrally formed, and therefore the number of parts can be reduced. Further, the boss portion 82*b* of the conveying gear 82 can be made small. For example, the above described distance "x" can be equal to or less than 5 mm. Thus, it is possible to increase the design freedom in designing of the parts of the conveying gear 82.

Embodiment 6.

Figure 17:
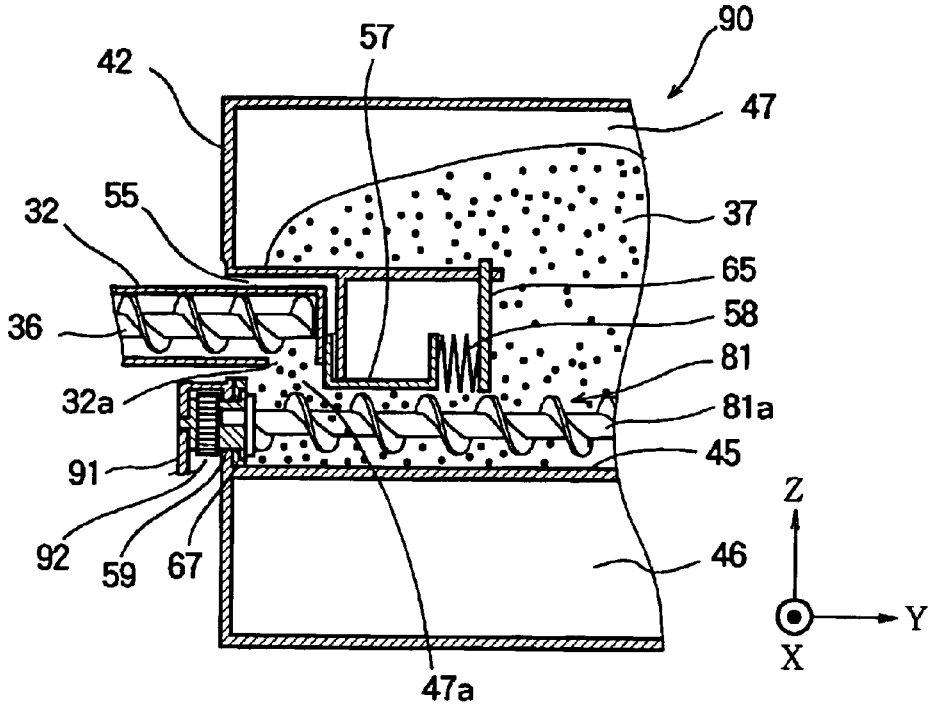
FIG. 17 is a sectional view of the main part of a developer container according to Embodiment 6 of the present invention.

FIG. 17 is a sectional view illustrating the main part of a toner container (i.e., a developer container) 90 according to Embodiment 6 of the present invention. The toner container 90 is detachably attached to the print process cartridge 15 (FIGS. 2 and 3) according to Embodiment 1. The toner container 90 replaces, for example, the toner container 40 (FIG. 4) according to Embodiment 1.

The toner container 90 is different from the toner container 80 (FIG. 15) according to Embodiment 5 in that a conveying gear 92 of the toner container 90 has a projecting end portion 92*a* (FIG. 18), and the toner container 90 has a gear restricting arm 91 rotatably supporting the projecting end portion 92*a* of the conveying gear 92. In Embodiment 6, components similar to those of the toner container 80 (FIG. 15) have been given the same reference numerals. The description of the toner container 90 is emphasized on the differences from the toner container 80. Reference will be made to the drawings showing the toner container 80 according to Embodiment 5 as necessary.

Figure 18:
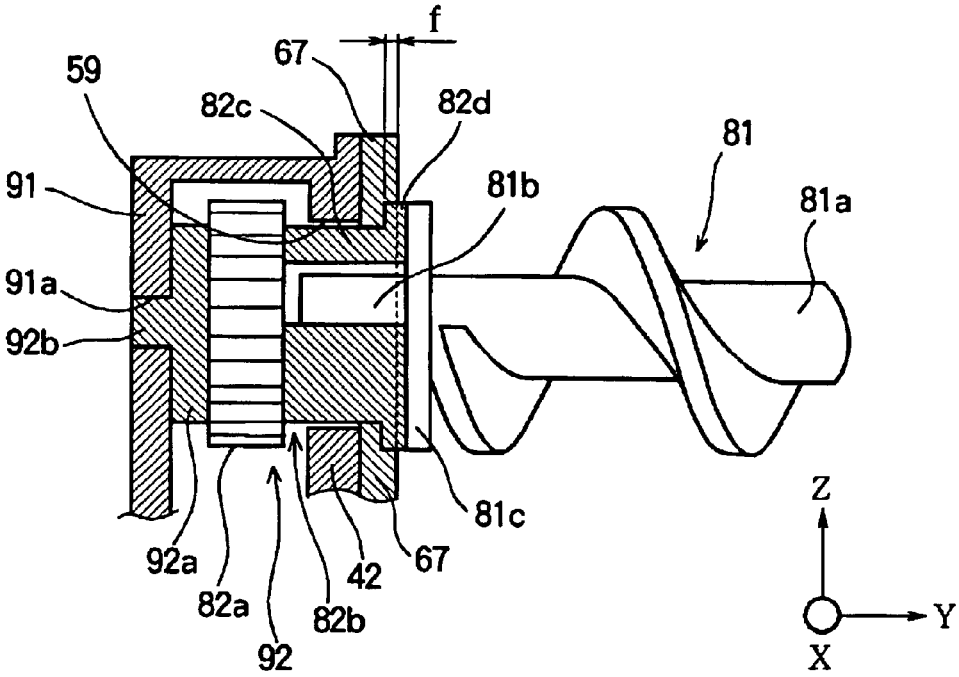
FIG. 18 is an enlarged sectional view of a conveying gear shown in FIG. 17.
Figure 19:
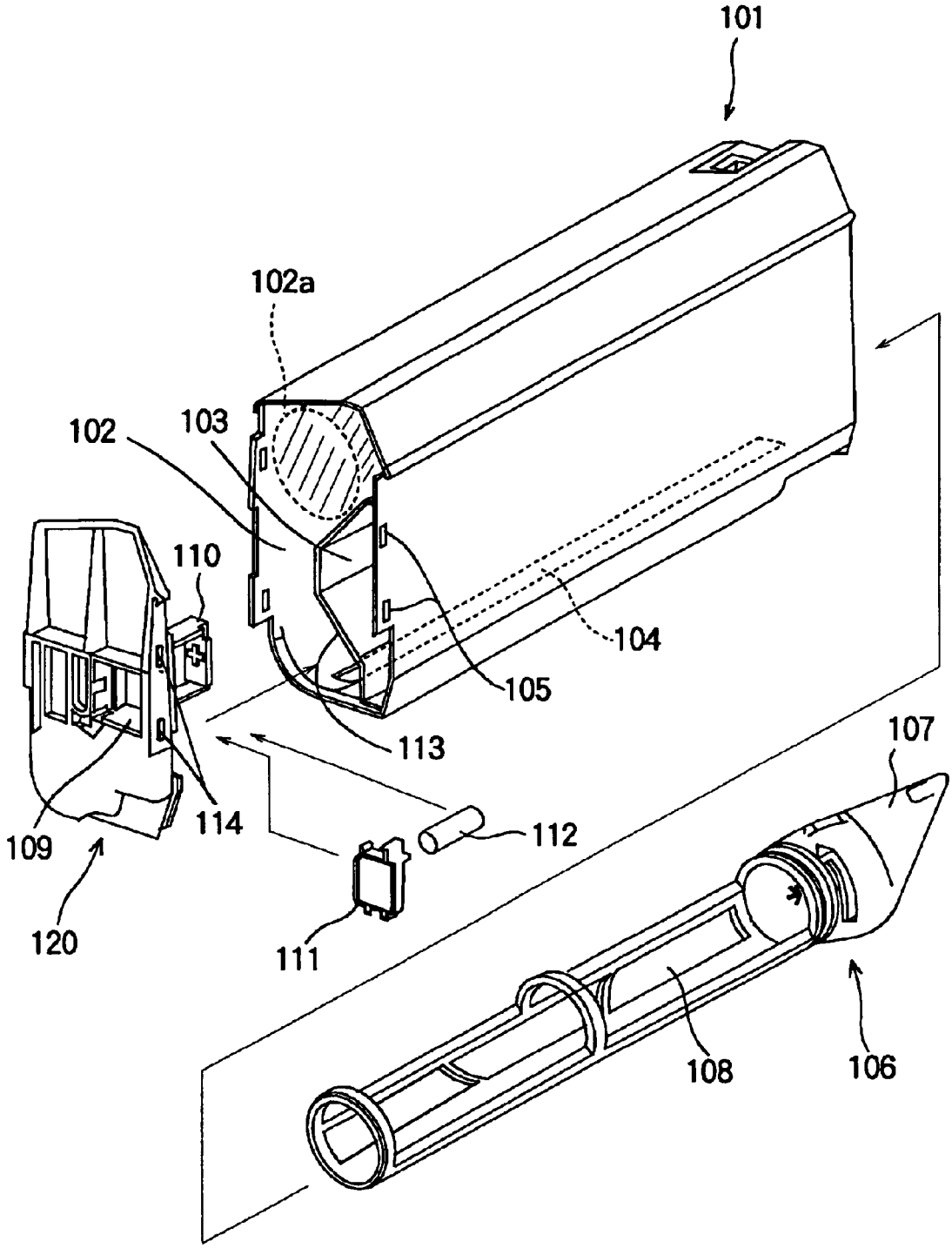
FIG.19 RELATED ART
FIG. 19 is an exploded perspective view of the main part of a conventional toner container that constitutes a waste toner collecting device.

FIG. 18 is an enlarged view of a part including the conveying gear 92 shown in FIG. 17.

As shown in FIG. 18, the conveying gear 92 has the projecting end portion 92*a* formed on the negative side (of Y-axis) of the gear portion 82*a*. The projecting end portion 92*a* has a rotation shaft projection 92*b*. The gear restricting arm 91 extends from the outer side (i.e., the negative side of Y-axis) of the side cover 42, and is bent so that the gear restricting arm 91 has an L-shaped cross section. The gear restricting arm 91 has a supporting hole 91*a* in which the rotation shaft projection 92*b* of the projecting end portion 92*a* is inserted. The projecting end portion 92*a* rotates together with the gear portion 82*a* in a state that the rotation shaft projection 92*b* is inserted in the supporting hole 91*a*.

The gear restricting arm 91 restricts the movement of the conveying gear 92 urged by the screw conveyor 81 in the negative direction of Y-axis. Thus, the amount "f" by which the flange portion 82*d* of the conveying gear 92 depresses the sponge 67 can be restricted within a predetermined range.

The operation of the above described construction will be described.

As was described in Embodiment 2 with reference to FIGS. 7 and 8, the tip of the toner discharging mechanism 32 urges the waste toner lid 57 in the positive direction of Y-axis and enters into the waste toner chamber 47 through the waste toner collection opening 55, causing the opening 47*a* to be formed in the waste toner chamber 47. The toner discharging mechanism 32 conveys the waste toner by means of the screw conveyor 36 and discharged the waste toner through the discharging opening 32*a*, so that the discharged waste toner falls in the interior of the waste toner chamber 47 through the opening 47*a*.

All of the waste toner 37 discharged from the discharging opening 32*a* can be conveyed by the screw conveyor 81. By the rotation of the screw conveyor 81 in the direction indicated by B (FIG. 16A), the waste toner 37 is conveyed in the positive direction of Y-axis so that the waste toner 37 is uniformly accumulated in the interior of the waste toner chamber 47.

When the amount of the waste toner 37 in the waste toner chamber 47 increases, the amount of the waste toner 37 conveyed by the screw conveyor 81 increases. Thus, the force with which the screw conveyor 81 urges the conveying gear 92 in the negative direction of Y-axis increases, and therefore the depressing amount "f" by which the flange portion 82*d* depresses the sponge 67 also increases. However, in Embodiment 6, the gear restricting arm 91 restricts the movement of the screw conveyor 81 in the negative direction of Y-axis, and therefore the depressing amount "f" does not exceed the predetermined amount.

As described above, according to the toner container 90 of Embodiment 6, even when the amount of the waste toner 37 in the waste toner chamber 47 increases (and therefore the force generated by the screw conveyor 81 in the negative direction of Y-axis also increases), the depressing amount "f" by which the flange portion 82*d* depresses the sponge 67 is restricted within the predetermined range. Therefore, it is possible to prevent the conveying gear 92 from causing a difficulty in rotating. Thus, it is possible to accomplish the stable conveying of the waste toner.

While the preferred embodiments of the present invention have been illustrated in detail, it should be apparent that modifications and improvements may be made to the invention without departing from the spirit and scope of the invention as described in the following claims.

What is claimed is:

1. A developer container detachably mountable in an image forming apparatus, said developer container comprising:

a hollow elongated outer body;

a fresh developer accommodating portion accommodating fresh developer, said fresh developer accommodating portion being provided in said outer body;

a waste developer accommodating portion accommodating waste developer, said waste developer accommodating portion being provided in said outer body; and a partition wall that separates said fresh developer accommodating portion from said waste developer accommodating portion in such a manner that said accommodating portions extend in the longitudinal direction of said outer body so that said accommodating portions are adjacent to each other, said partition wall extending from a top wall of said outer body, wherein a width, in the horizontal direction substantially perpendicular to said longitudinal direction, of the interior of an upper part of said fresh developer accommodating portion immediately adjacent said top wall is substantially equal to or less than a corresponding width of a lower part of said fresh developer accommodating portion everywhere below said upper part in a state where said developer container is mounted in said image forming apparatus.

2. An image forming apparatus in which said developer container according to claim 1 is mounted.

3. The developer container according to claim 1, wherein said partition wall is so formed that said fresh developer accommodating portion becomes broader from said top wall to a bottom of said outer body.

4. The developer container according to claim 3, wherein said partition wall includes a portion having an arc-shaped cross-section in the vicinity of said bottom of said outer body.

5. A developer container detachably attachable to a print process cartridge, said print process cartridge including a developer discharging mechanism that discharges waste developer through a waste developer discharging opening, said developer container comprising:

a waste developer accommodating portion having a collection opening that receives said developer discharging mechanism so that said waste developer discharged from said waste developer discharging opening is accommodated in said waste developer accommodating portion;

a guide member extending inwardly of said waste developer accommodating portion from a first position of said waste developer accommodating portion, said first position being situated in the vicinity of an upper peripheral position of said collection opening in a state where said developer container is attached to said print process cartridge;

a waste developer lid provided in said waste developer accommodating portion, said waste developer lid being slidably guided by said guide member so as to open and close said collection opening; and a resilient urging mechanism that urges said waste developer lid in the direction in which said waste developer lid closes said collection opening, wherein said waste developer lid moves away from said collection opening overcoming the force of said resilient urging mechanism when said waste developer discharging opening receives said developer discharging mechanism, and wherein said guide member covers at least said collection opening from above in a state where said developer container is attached to said print process cartridge.

6. The developer container according to claim 5, further comprising:

a developer conveyor extending inwardly of said waste developer accommodating portion from a second position of said waste developer accommodating portion, said second position being situated below said collection opening in a state where said developer container is attached to said print process cartridge, said developer conveyor having an axial end portion which has a semicircular cross section; and a conveying gear including:

a gear portion provided outside said waste developer accommodating portion;

a shaft portion rotatably supported by a supporting hole formed on a third position of said waste developer accommodating portion, said third position being situated below said collection opening in a state where said developer container is attached to said print process cartridge; and a holding hole that holds said axial end portion of said developer conveyor in said waste developer accommodating portion and has an engaging projection engaging said axial end portion.

7. The developer container according to claim 6, wherein the position of said waste developer discharging opening along an axis of said developer conveyor is aligned with a portion in which a helical blade is formed on said developer conveyor, in a state where said waste developer discharging opening of said developer discharging mechanism has entered into said waste developer accommodating portion.

8. The developer container according to claim 6, further comprising:

a sponge provided in said waste developer accommodating portion and disposed in the vicinity of said supporting hole;

a flange portion formed on said conveying gear, said flange portion being disposed at such a position that said flange portion is able to abut against said sponge to restrict the movement of said conveying gear in the direction away from said waste developer accommodating portion;

a projecting end portion of said conveying gear, said projecting end portion having a rotation shaft projection; and a gear restricting arm provided outside said waste developer accommodating portion, said gear restricting arm rotatably supporting said rotation shaft projection so as to restrict the movement of said conveying gear in the direction away from said waste developer accommodating portion.

9. An image forming apparatus in which said developer container according to claim 5 is mounted.

10. A print process cartridge to which a developer container is detachably attachable, said developer container including a waste developer accommodating portion accommodating waste developer and a collection opening that opens to the interior of said waste developer accommodating portion, said print process cartridge comprising:

a discharging mechanism having a waste developer discharging opening through which said waste developer is discharged, and a discharging lid that opens and closes said waste developer discharging opening, wherein said discharging lid opens said waste developer discharging opening of said developer discharging mechanism when said waste developer discharging opening of said developer discharging mechanism enters into said waste developer accommodating portion through said collection opening, and said discharging lid closes said waste developer discharging opening when said waste developer discharging opening of said developer discharging mechanism moves out of said waste developer accommodating portion through said collection opening.

11. The print process cartridge according to claim 10, wherein said developer discharging mechanism comprises:

a cylindrical portion having a closed end, said waste developer discharging opening being formed on a circumferential wall in the vicinity of said closed end;

a movement-restricting rib formed on said circumferential wall of said cylindrical portion, said movement-restricting rib extending by a predetermined amount from the vicinity of said closed end in the direction substantially parallel to an axis of said cylindrical portion;

a guide projection formed on said circumferential wall and disposed in the vicinity of said closed end so that the rotational position of said guide projection about said axis is apart from that of said movement-restricting rib by a certain angle;

said discharging lid being made of a ring-shaped member that can fit around said cylindrical portion, said discharging lid having first and second guide grooves extending in the direction substantially parallel to said axis of said cylindrical portion so that the rotational positions of said first and second grooves about said axis are apart from each other by said angle; and a coil spring that urges said discharging lid, wherein said discharging lid can be mounted on said cylindrical portion by fitting said discharging lid around said cylindrical portion overcoming the force of said coil spring in such a manner that said guide projection engages said first guide groove and said movement-restricting rib engages said second guide groove, and by rotating said cylindrical portion in such a manner that said movement-restricting rib engages said first guide groove and said guide projection abuts against an end surface of said discharging lid so as to restrict the movement of said discharging lid urged by said coil spring.

12. An image forming apparatus having said print process cartridge according to claim 10 as a detachable unit.

* * * * *